US010704001B2

(12) United States Patent
Kar et al.

(10) Patent No.: US 10,704,001 B2
(45) Date of Patent: Jul. 7, 2020

(54) MULTI-STAGE UPGRADING PYROLYSIS TAR PRODUCTS

(71) Applicant: ExxonMobil Research and Engineering Company, Annandale, NJ (US)

(72) Inventors: Kenneth Chi Hang Kar, Philadelphia, PA (US); Sheryl B. Rubin-Pitel, Newtown, PA (US); David T. Ferrughelli, Easton, PA (US); Anthony S. Mennito, Flemington, NJ (US); Teng Xu, Houston, TX (US)

(73) Assignee: EXXONMOBIL RESEARCH AND ENGINEERING COMPANY, Annandale, NJ (US)

( * ) Notice: Subject to any disclaimer, the term of this patent is extended or adjusted under 35 U.S.C. 154(b) by 57 days.

(21) Appl. No.: 16/025,276

(22) Filed: Jul. 2, 2018

(65) Prior Publication Data

US 2019/0016980 A1 Jan. 17, 2019

Related U.S. Application Data

(60) Provisional application No. 62/532,441, filed on Jul. 14, 2017.

(51) Int. Cl.
*C10L 1/04* (2006.01)
*C10G 65/00* (2006.01)

(52) U.S. Cl.
CPC ..... *C10L 1/04* (2013.01); *C10G 65/00* (2013.01); *C10G 2300/202* (2013.01); *C10G 2300/301* (2013.01)

(58) Field of Classification Search
CPC ..... C10L 1/04; C10G 65/00; C10G 2300/202; C10G 2300/301
See application file for complete search history.

(56) References Cited

U.S. PATENT DOCUMENTS 4,997,544 A * 3/1991 Chou ..... C10G 65/04 208/149
5,871,634 A 2/1999 Wiehe et al.
5,976,201 A * 11/1999 Barry ..... C10L 1/026 208/15
6,004,361 A * 12/1999 Barry ..... C10L 1/08 208/15
7,972,496 B2 * 7/2011 Tanaka ..... C08K 5/01 208/19

(Continued)

FOREIGN PATENT DOCUMENTS

WO 2013033580 A2 3/2013
WO 2013033590 A2 3/2013

OTHER PUBLICATIONS

The International Search Report and Written Opinion of PCT/US2018/040568 dated Oct. 1, 2018.

*Primary Examiner* — Pamela H Weiss
(74) *Attorney, Agent, or Firm* — Robert A. Migliorini

(57) ABSTRACT

A first hydroprocessed product and a second hydroprocessed product produced from a multi-stage process for upgrading pyrolysis tar, such as steam cracker tar, are provided herein. Fuel blends including the first hydroprocessed product and/or the second hydroprocessed product are also provided herein as well as methods of lowering pour point of a gas oil using the first hydroprocessed product and the second hydroprocessed product.

21 Claims, 3 Drawing Sheets

(56) References Cited

U.S. PATENT DOCUMENTS

| | | | | |
|---|---|---|---|---|
| 8,758,595 | B2 * | 6/2014 | Tanaka | C08K 5/01 208/14 |
| 9,090,835 | B2 | 7/2015 | Beech, Jr. et al. | |
| 9,090,836 | B2 | 7/2015 | Brown et al. | |
| 9,102,884 | B2 | 8/2015 | Xu et al. | |
| 9,580,523 | B2 | 2/2017 | Wong et al. | |
| 9,637,694 | B2 | 5/2017 | Evans et al. | |
| 9,657,239 | B2 | 5/2017 | Beech, Jr. et al. | |
| 10,047,299 | B2 * | 8/2018 | Rubin-Pitel | C10L 1/08 |
| 10,316,263 | B2 * | 6/2019 | Rubin-Pitel | C10L 1/04 |
| 10,433,006 | B2 * | 10/2019 | Dua | H04L 29/12066 |
| 10,550,335 | B2 * | 2/2020 | Rubin-Pitel | C10G 67/0454 |
| 10,571,452 | B2 * | 2/2020 | Koseoglu | G01N 33/2811 |
| 2011/0198264 | A1 * | 8/2011 | Tanaka | C08K 5/01 208/19 |
| 2013/0081978 | A1 | 4/2013 | Brown et al. | |
| 2013/0081979 | A1 | 4/2013 | Brown et al. | |
| 2014/0061094 | A1 | 3/2014 | Xu et al. | |
| 2014/0061096 | A1 | 3/2014 | Brown et al. | |
| 2014/0061100 | A1 | 3/2014 | Lattner et al. | |
| 2014/0174980 | A1 | 6/2014 | Brown et al. | |
| 2015/0036857 | A1 | 2/2015 | Wu | |
| 2015/0315496 | A1 | 11/2015 | Soultanidis et al. | |
| 2015/0344785 | A1 | 12/2015 | Soultanidis et al. | |
| 2015/0344790 | A1 | 12/2015 | Ferrughelli et al. | |
| 2015/0361354 | A1 | 12/2015 | Xu et al. | |
| 2015/0361359 | A1 | 12/2015 | Beech, Jr. et al. | |
| 2016/0122667 | A1 | 5/2016 | Evans et al. | |
| 2016/0177205 | A1 | 6/2016 | Evans et al. | |
| 2017/0002273 | A1 * | 1/2017 | Rubin-Pitel | C10G 47/02 |
| 2017/0002279 | A1 * | 1/2017 | Brown | C10L 1/06 |
| 2018/0057759 | A1 | 3/2018 | Kandel et al. | |
| 2018/0187105 | A1 * | 7/2018 | Owens | C10M 101/02 |

* cited by examiner

MULTI-STAGE UPGRADING PYROLYSIS TAR PRODUCTS

CROSS-REFERENCE TO RELATED APPLICATIONS

This application claims priority to U.S. Provisional Application Ser. No. 62/532,441 filed Jul. 14, 2017, which is herein incorporated by reference in its entirety.

FIELD OF THE INVENTION

The invention relates to products produced from a multi-stage process for hydroprocessing pyrolysis tars, typically those resulting from steam cracking, and use of those products as fuel oil blendstocks.

BACKGROUND OF THE INVENTION

Pyrolysis processes, such as steam cracking, are utilized for converting saturated hydrocarbons to higher-value products such as light olefins, e.g., ethylene and propylene. Besides these useful products, hydrocarbon pyrolysis can also produce a significant amount of relatively low-value heavy products, such as pyrolysis tar. When the pyrolysis is steam cracking, the pyrolysis tar is identified as steam-cracker tar ("SCT").

Pyrolysis tar is a high-boiling, viscous, reactive material comprising complex, ringed and branched molecules that can polymerize and foul equipment. Pyrolysis tar also contains high molecular weight non-volatile components including paraffin insoluble compounds, such as pentane-insoluble compounds and heptane-insoluble compounds. Particularly challenging pyrolysis tars contain >0.5 wt %, sometimes >1.0 wt % or even >2.0 wt % of toluene insoluble compounds. The high molecular weight compounds are typically multi-ring structures that are also referred to as tar heavies ("TH"). These high molecular weight molecules can be generated during the pyrolysis process, and their high molecular weight leads to high viscosity, which limits desirable pyrolysis tar disposition options. For example, it is desirable to find higher-value uses for SCT, such as for fluxing with heavy hydrocarbons, especially heavy hydrocarbons of relatively high viscosity. It is also desirable to be able to blend SCT with one or more heavy oils, examples of which include bunker fuel, burner oil, heavy fuel oil (e.g., No. 5 or No. 6 fuel oil), marine fuel oil, high-sulfur fuel oil, low-sulfur oil, regular-sulfur fuel oil ("RSFO"), Emission Controlled Area fuel (ECA) with <0.1 wt % sulfur and the like. Further, it is expected that the future market will have excess vacuum oil based materials, which may be pour point and/or viscosity limited for fuel oil blending, particularly marine fuel oil blending.

One difficulty encountered when blending heavy hydrocarbons is fouling that results from precipitation of high molecular weight molecules, such as asphaltenes. See, e.g., U.S. Pat. No. 5,871,634, which is incorporated herein by reference in its entirety. In order to mitigate asphaltene precipitation, an Insolubility Number, $I_N$, and a Solvent Blend Number, $S_{BN}$, are determined for each blend component. Successful blending is accomplished with little or substantially no precipitation by combining the components in order of decreasing $S_{BN}$, so that the $S_{BN}$ of the blend is greater than the $I_N$ of any component of the blend. Pyrolysis tars generally have high $S_{BN}$>135 and high $I_N$>80 making them difficult to blend with other heavy hydrocarbons.

Pyrolysis tars having $I_N$>100, e.g., >110 or >130, are particularly difficult to blend without phase separation.

Attempts at hydroprocessing pyrolysis tar to reduce viscosity and improve both $I_N$ and $S_{BN}$ have not led to a commercializable process, primarily because fouling of process equipment could not be substantially mitigated. For example, hydroprocessing neat SCT results in rapid catalyst coking when the hydroprocessing is carried out at a temperature in the range of about 250° C. to 380° C. and a pressure in the range of about 5400 kPa to 20,500 kPa, using a conventional hydroprocessing catalyst containing one or more of Co, Ni, or Mo. This coking has been attributed to the presence of TH in the SCT that leads to the formation of undesirable deposits (e.g., coke deposits) on the hydroprocessing catalyst and the reactor internals. As the amount of these deposits increases, the yield of the desired upgraded pyrolysis tar (upgraded SCT) decreases and the yield of undesirable byproducts increases. The hydroprocessing reactor pressure drop also increases, often to a point where the reactor is inoperable.

One approach taken to overcome these difficulties is disclosed in International Patent Application Publication No. WO 2013/033580, which is incorporated herein by reference in its entirety. The application reports hydroprocessing SCT in the presence of a utility fluid comprising a significant amount of single and multi-ring aromatics to form an upgraded pyrolysis tar product. The upgraded pyrolysis tar product generally has a decreased viscosity, decreased atmospheric boiling point range, increased density and increased hydrogen content over that of the SCT feedstock, resulting in improved compatibility with fuel oil and blend-stocks. Additionally, efficiency advances involving recycling a portion of the upgraded pyrolysis tar product as utility fluid are reported in International Patent Application Publication No. WO 2013/033590 incorporated herein by reference in its entirety.

U.S. Published Patent Application No. 2015/0315496, which is incorporated herein by reference in its entirety, reports separating and recycling a mid-cut utility fluid from the upgraded pyrolysis tar product. The utility fluid comprises ≥10.0 wt % aromatic and non-aromatic ring compounds and each of the following: (a) ≥1.0 wt % of 1.0 ring class compounds; (b) ≥5.0 wt % of 1.5 ring class compounds; (c) ≥5.0 wt % of 2.0 ring class compounds; and (d) ≥0.1 wt % of 5.0 ring class compounds.

U.S. Published Patent Application No. 2015/036857, which is incorporated herein by reference in its entirety, reports separating and recycling a utility fluid from the upgraded pyrolysis tar product. The utility fluid contains 1-ring and/or 2-ring aromatics and has a final boiling point ≤430° C.

U.S. Published Patent Application No. 2016/0122667, which is incorporated herein by reference in its entirety, reports a process for upgrading pyrolysis tar, such as SCT, in the presence of a utility fluid which contains 2-ring and/or 3-ring aromatics and has solubility blending number ($S_{BN}$) ≥120.

Provisional U.S. Patent Application 62/380,538 filed Aug. 29, 2016, which is incorporated herein by reference in its entirety, reports hydroprocessing conditions at higher pressure >8 MPa and a lower weight hourly space velocity of combined pyrolysis tar and utility fluid as low as 0.3 $hr^{-1}$.

Despite these advances, there remains a need for further improvements in tar hydroprocessing, which allow for the production of upgraded tar products that can be successfully used as fuel oil blendstocks and are produced without compromising the lifetime of the hydroprocessing reactor.

Further, there is a need for fuel blendstocks for low sulfur fuel oil (LSFO) and ultra low sulfur fuel oil (ULSFO) including marine fuel oil. In particular, there is a need for fuel blendstocks that can be blended with marine fuel oil and can lower marine fuel oil pour point while maintaining a suitable viscosity, energy content and/or sulfur content.

SUMMARY OF THE INVENTION

It has been discovered that tar hydroprocessing can produce products having desirable compositions and properties, such as lower sulfur content, higher aromatic content, lower pour point and lower viscosity when tar hydroprocessing occurs as a multi-stage process. For example, the tar hydroprocess may be separated into at least two hydroprocessing zones or stages. These products produced during multi-stage hydroprocessing, for example, a first hydroprocessed product and a second hydroprocessed product, can advantageously be used as a LSFO and/or a ULSFO, as well as blendstocks for LSFO and ULSFO including marine fuel oil.

Thus, the invention relates to a first hydroprocessed product. The first hydroprocessed product can comprise aromatics in an amount ≥about 50 wt %, paraffins in an amount ≤about 5.0 wt %, and sulfur in an amount from about 0.10 wt % to <0.50 wt %. Further, the first hydroprocessed product can have a boiling point distribution of about 145° C. to about 760° C. as measured according to ASTM D6352, a pour point of ≤about 0.0° C., as measured according to ASTM D5949 or ASTMD7346, and a kinematic viscosity at 50° C. from 20 $mm^2/s$ to 200 $mm^2/s$, as measured according to ASTM D7042.

In another aspect, the invention relates to a second hydroprocessed product. The second hydroprocessed product can comprise aromatics in an amount ≥about 50 wt %, paraffins in an amount ≤about 5.0 wt %, and sulfur in an amount ≤0.30 wt %. Further, the second hydroprocessed product can have a boiling point distribution of about 140° C. to about 760° C. as measured according to ASTM D6352, a pour point of ≤about 0.0° C., as measured according to ASTM D5949, and a kinematic viscosity at 50° C. from 100 $mm^2/s$ to 800 $mm^2/s$, as measured according to ASTM D7042.

In still another aspect, the invention relates to a fuel blend. The fuel blend may comprise the first hydroprocessed product as described herein and/or the second shydroprocessed product as described herein and a fuel stream.

In still another aspect, the invention relates to a method of lowering the pour point of a gas oil. The method for lowering the pour point may comprise blending a first hydroprocessed product as described herein and/or a second hydroprocessed product of as described herein with a gas oil to form a blended gas oil, which has a pour point lower than the pour point of the gas oil.

DETAILED DESCRIPTION

I. Multi-Stage Hydroprocessing Products

Figure 1:
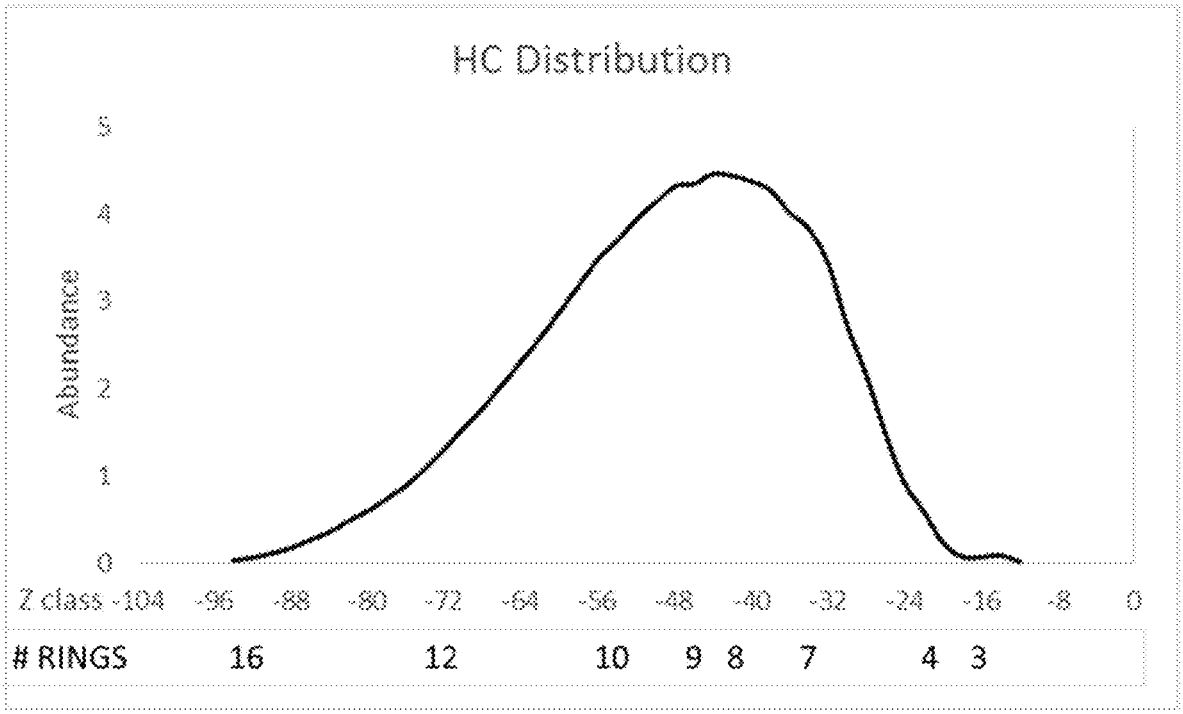
FIG. 1 illustrates distribution of aromatic rings in the First Hydroprocessed Product II where the x-axis represents the number of aromatic rings and the y-axis represents % mass.

Disclosed herein are products of a hydrocarbon conversion process in which a feedstock comprising pyrolysis tar hydrocarbon (e.g., ≥10.0 wt %) and a utility fluid may be hydroprocessed in one or more hydroprocessing zones or stages (e.g., a first stage, a second stage, etc.) in the presence of a treat gas comprising molecular hydrogen under catalytic hydroprocessing conditions to produce a hydroprocessed product (e.g., a first hydroprocessed product, a second hydroprocessed product). Further details regarding the hydrocarbon conversion process are provided in later sections of the present disclosure.

A. First Hydroprocessed Product

In various aspects, a first hydroprocessed product is provided herein. It is contemplated herein that the first hydroprocessed product is intended to encompass a product resultant from a single hydroprocessing zone or stage or a product resultant from a first hydroprocessing zone or stage of a multi-stage hydroprocess. In some embodiments, the first hydroprocessed product may be referred to as a first stage hydroprocessed product. The first hydroprocessed product may comprise sulfur, paraffins and aromatics in suitable amounts and have desirable properties such as, but not limited to pour point and viscosity, such that the first hydroprocessed product may be a suitable fuel oil and/or a suitable fuel oil blendstock.

In particular, the first hydroprocessed product may have a sulfur content, based on total weight of the first hydroprocessed product, of ≤about 5.0 wt %, ≤about 2.5 wt %, ≤about 1.0 wt %, ≤about 0.75 wt %, ≤about 0.50 wt %, ≤about 0.40 wt %, ≤about 0.30 wt %, ≤about 0.20 wt %, or about 0.10 wt %. For example, the first hydroprocessed product may have a sulfur content, based on total weight of the first hydroprocessed product, of about 0.10 wt % to about 5.0 wt %, about 0.10 wt % to about 1.0 wt %, about 0.10 wt % to about 0.50 wt %, about 0.10 wt % to about 0.40 wt % or about 0.10 wt % to about 0.30 wt %. Preferably, the first hydroprocessed product may have a sulfur content, based on total weight of the first hydroprocessed product, of about 0.10 wt % to <about 0.50 wt %. Advantageously, due its low sulfur content, the first hydroprocessed product may be suitable as a LSFO and/or can be used to extend the LSFO pool, which may permit the blending of regular sulfur fuel oil (RSFO) having a higher sulfur content >0.50 wt % and/or a more viscous blendstock material with a LSFO. Further, using the first hydroprocessed product as a blendstock can avoid the use a distillate, which may have an undesirably lower energy content. Additionally, the first hydroprocessed product may be used to correct LSFO that may be off-specification (off-spec) with respect to sulfur content.

Additionally or alternatively, the first hydroprocessed product may have a lower paraffin content, which can advantageously lower the risk for wax precipitation and filter blocking in fuel systems. As used herein, the term "paraffin," alternatively referred to as "alkane," refers to a saturated hydrocarbon chain of 1 to about 25 carbon atoms in length, such as, but not limited to methane, ethane, propane and butane. The paraffin may be straight-chain or branched-chain and is considered to be a non-ring compound. "Paraffin" is intended to embrace all structural isomeric forms of paraffins. For example, the first hydroprocessed product may have a paraffin content, based on total weight of the first hydroprocessed product, of ≤about 10 wt %, ≤about 7.5 wt %, ≤about 5.0 wt %, ≤about 2.5 wt %, ≤about 1.0 wt %, ≤about 0.50 wt %, or about 0.10 wt %. Preferably, the first hydroprocessed product may have a paraffin content, based on total weight of the first hydroprocessed product, of ≤about 5.0 wt %, ≤about 2.5 wt %, ≤about 1.0 wt %, or ≤about 0.50 wt %. Additionally or alternatively, the first hydroprocessed product may have a paraffin content, based on total weight of the first hydroprocessed product, of about 0.10 wt % to about 10 wt %, about 0.10 wt % to about 5.0 wt %, about 0.10 wt % to about 1.0 wt %, or about 0.10 wt % to about 0.50 wt %.

Additionally or alternatively, the first hydroprocessed product may comprise a higher amount of aromatics, including alkyl-functionalized derivatives thereof rendering it more compatible with various residual fuel oils. For example, the first hydroprocessed product can comprise ≥40 wt %, ≥50 wt %, ≥60 wt %, ≥70 wt %, ≥80 wt %, ≥90 wt % or >95 wt % aromatics, including those having one or more hydrocarbon substituents, such as from 1 to 4 or 1 to 3 or 1 to 2 hydrocarbon substituents. Such substituents can be any hydrocarbon group that is consistent with the overall solvent distillation characteristics. Examples of such hydrocarbon groups include, but are not limited to, those selected from the group consisting of $C_1$-$C_6$ alkyl, wherein the hydrocarbon groups can be branched or linear and the hydrocarbon groups can be the same or different. Optionally, the first hydroprocessed product can comprise ≥85 wt % based on the weight of the first hydroprocessed product of one or more of benzene, ethylbenzene, trimethylbenzene, xylenes, toluene, naphthalenes, alkylnaphthalenes (e.g., methylnaphthalenes), tetralins, alkyltetralins (e.g., methyltetralins), phenanthrenes, or alkyl phenanthrenes.

It is generally desirable for the first hydroprocessed product to be substantially free of molecules having terminal unsaturates, for example, vinyl aromatics, particularly in embodiments utilizing a hydroprocessing catalyst having a tendency for coke formation in the presence of such molecules. The term "substantially free" in this context means that the first hydroprocessed product comprises ≤10.0 wt % (e.g., ≤5.0 wt % or ≤1.0 wt %) vinyl aromatics, based on the weight of the first hydroprocessed product.

Generally, the first hydroprocessed product contains sufficient amount of molecules having one or more aromatic cores. For example, the first hydroprocessed product can comprise ≥50.0 wt % of molecules having at least one aromatic core (e.g., ≥60.0 wt %, such as ≥70 wt %) based on the total weight of the first hydroprocessed product. In an embodiment, the first hydroprocessed product can comprise (i) ≥60.0 wt % of molecules having at least one aromatic core and (ii) ≤1.0 wt % of vinyl aromatics, the weight percents being based on the weight of the first hydroprocessed product.

The first hydroprocessed product will now be described in terms of moieties falling into distinct ring classes as determined by two-dimensional gas chromatography (2D GC). Details regarding 2D GC methods are further provided herein in later sections. Preferred, among each ring class described, are those moieties comprising at least one aromatic core.

In this description and appended claims, a "0.5 ring class compound" means a molecule having only one non-aromatic ring moiety and no aromatic ring moieties in the molecular structure.

The term "non-aromatic ring" means four or more carbon atoms joined in at least one ring structure wherein at least one of the four or more carbon atoms in the ring structure is not an aromatic carbon atom. Aromatic carbon atoms can be identified using, e.g., $^{13}C$ Nuclear magnetic resonance, for example. Non-aromatic rings having atoms attached to the ring (e.g., one or more heteroatoms, one or more carbon atoms, etc.), but which are not part of the ring structure, are within the scope of the term "non-aromatic ring."

Examples of non-aromatic rings include:

a pentacyclic ring—five carbon member ring such as

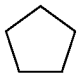

cyclopentane (ii) a hexcyclic ring—six carbon member ring such as

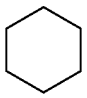

cyclohexane

The non-aromatic ring can be saturated as exemplified above or partially unsaturated for example, cyclopentene, cyclopenatadiene, cyclohexene and cyclohexadiene.

Non-aromatic rings (which in SCT are primarily six and five member non-aromatic rings), can contain one or more heteroatoms such as sulfur (S), nitrogen (N) and oxygen (O) and may be referred to as "heteroatom non-aromatic rings." Non-limiting examples of heteroatom non-aromatic rings with heteroatoms includes the following:

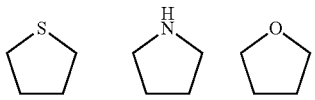

tetrahydrothiophene pyrrolidine tetrahydrofuran

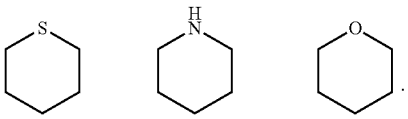

tetrahydro-2H-thiopyran piperidine tetrahydro-2H-pyran.

The heteroatom non-aromatic rings can be saturated as exemplified above or partially unsaturated.

The term "aromatic ring" means five or six atoms joined in a ring structure wherein (i) at least four of the atoms joined in the ring structure are carbon atoms and (ii) all of the carbon atoms joined in the ring structure are aromatic carbon atoms. Aromatic rings having atoms attached to the ring (e.g., one or more heteroatoms, one or more carbon atoms, etc.) but which are not part of the ring structure are within the scope of the term "aromatic ring."

Representative aromatic rings include, e.g.:

(i) a benzene ring

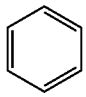

benzene (ii) a thiophene ring such as

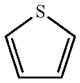

thiophene (iii) a pyrrole ring such as

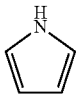

1H-pyrrole (iv) a furan ring such as

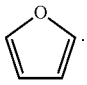

furan

When there is more than one ring in a molecular structure, the rings can be aromatic rings and/or non-aromatic rings. The ring-to-ring connection can be of two types: type (1) where at least one side of the ring is shared, and type (2) where the rings are connected with at least one bond. The type (1) structure is also known as a fused ring structure. The type (2) structure is also commonly known as a bridged ring structure.

A few non-limiting examples of the type (1) fused ring structure are as follows:

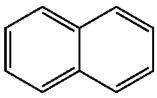

naphthalene

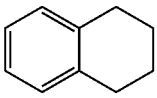

1, 2, 3, 4-tetrahydronaphthalene

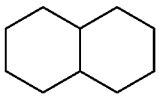

decahydronaphthalene

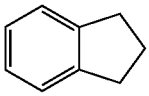

indane

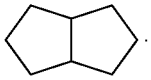

octahydropentalene

A non-limiting example of the type (2) bridged ring structure is as follows:

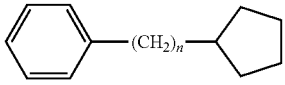

where n=0, 1, 2, or 3.

When there are two or more rings (aromatic rings and/or non-aromatic rings) in a molecular structure, the ring-to-ring connection may include all type (1) or type (2) connections or a mixture of both types (1) and (2).

The following define the compound classes for the multi-ring compounds for the purpose of this description and appended claims:

Compounds of the 1.0 ring class contain only one of the following ring moieties but no other ring moieties:

(i) one aromatic ring [1·(1.0 ring)] in the molecular structure.

Compounds of the 1.5 ring class contain only one of the following ring moieties, but no other ring moieties:

(i) one aromatic ring [1·(1.0 ring)] and one non-aromatic ring [1·(0.5 ring)] in the molecular structure, or (ii) three non-aromatic rings [3·(0.5 ring)] in the molecular structure.

Compounds of the 2.0 ring class contain only one of the following ring moieties, but no other ring moieties:

(i) two aromatic rings [2·(1.0 ring)], or (ii) one aromatic ring [1·(1.0 ring)] and two non-aromatic rings [2·(0.5 ring)] in the molecular structure, or (iii) four non-aromatic rings [4·(0.5 ring)] in the molecular structure.

Compounds of the 2.5 ring class contain only one of the following ring moieties but no other ring moieties:

(i) two aromatic rings [2·(1.0 ring)] and one non-aromatic rings [1·(0.5 ring)] in the molecular structure or (ii) one aromatic ring [1·(1.0 ring)] and three non-aromatic rings [3·(0.5 ring)] in the molecular structure or (iii) five non-aromatic rings [5·(0.5 ring)] in the molecular structure.

Likewise compounds of the 3.0, 3.5, 4.0, 4.5, 5.0, etc. molecular classes contain a combination of non-aromatic rings counted as 0.5 ring, and aromatic rings counted as 1.0 ring, such that the total is 3.0, 3.5, 4.0, 4.5, 5.0, 5.5, 6.0, 6.5, 7.0, etc. respectively.

For example, compounds of the 5.0 ring class contain only one of the following ring moieties but no other ring moieties:

(i) five aromatic rings [5·(1.0 ring)] or (ii) four aromatic rings [4·(1.0 ring)] and two non-aromatic rings [2·(0.5 ring)] in the molecular structure or (iii) three aromatic rings [3·(1.0 ring)] and four non-aromatic rings [4·(0.5 ring)] in the molecular structure or (iv) two aromatic rings [2·(1.0 ring)] and six non-aromatic rings [6·(0.5 ring)] in the molecular structure or (v) one aromatic ring [1·(1.0 ring)] and eight non-aromatic rings [8·(0.5 ring)] in the molecular structure or (vi) ten non-aromatic rings [10·(0.5 ring)] in the molecular structure.

The first hydroprocessed product may comprise 0.5, 1.0, 1.5, 2.0, 2.5, 3.0, 3.5, 4.0, 4.5, 5.0 and 5.5 ring class compounds. The first hydroprocessed product can further comprise ≤1.0 wt %, e.g., ≤0.5 wt %, ≤0.1 wt %, ≤0.05 wt %, such as ≤0.01 wt % of 5.5 ring class compounds, based on the weight of the first hydroprocessed product. Additionally, the first hydroprocessed product can include no 5.5 ring class compounds. The first hydroprocessed product can further comprise ≤1.0 wt %, e.g., ≤0.5 wt %, ≤0.1 wt %, ≤0.05 wt %, such as ≤0.03 wt % of 5.0 ring class compounds, based on the weight of the first hydroprocessed product. Additionally, the first hydroprocessed product can include no 5.0 ring class compounds. Preferably, the first hydroprocessed product comprises ≤0.1 wt %, e.g., ≤0.05 wt %, such as ≤0.01 wt % total of 6.0, 6.5, and 7.0 ring class compounds, based on the weight of the utility fluid. Additionally, the first hydroprocessed product can include no 6.0, 6.5, and/or 7.0 ring class compounds. Alternatively, the first hydroprocessed product may comprise from 1.0 to 7.0 ring class compounds. Preferably, the first hydroprocessed product comprises from 1.0 to 5.5 ring class compounds. The first hydroprocessed product can further comprise ≤5.0 wt %, e.g., ≤3.0 wt %, ≤2.0 wt %, such as ≤1.8 wt % of non-aromatic ring compounds, such as naphthenes.

In various aspects, the first hydroprocessed product can comprise one or more of:

(i) ≥1.0 wt % of 1.0 ring class compounds or ≥2.5 wt % of 1.0 ring class compounds;

(ii) ≥5.0 wt % of 1.5 ring class compounds, ≥10 wt % of 1.5 ring class compounds, or >15 wt % of 1.5 ring class compounds;

(iii) ≥10 wt % of 2.0 ring class compounds, ≥15 wt % of 2.0 ring class compounds, ≥20 wt % of 2.0 ring class compounds, or >25 wt % of 2.0 ring class compounds;

(iv) ≥10 wt % of 2.5 ring class compounds, ≥15 wt % of 2.5 ring class compounds, or >18 wt % of 2.5 ring class compounds;

(v) ≥2.0 wt % of 3.0 ring class compounds, ≥5.0 wt % of 3.0 ring class compounds, or >8.0 wt % of 3.0 ring class compounds; and (vi) ≥1.0 wt % of 3.5 ring class compounds, ≥2.0 wt % of 3.5 ring class compounds, or >4.0 wt % of 3.5 ring class compounds;

based on the weight of the first hydroprocessed product.

Optionally, the first hydroprocessed product can comprises one or more of (i) ≤5.0 wt % of 4.0 ring class compounds or ≤3.0 wt % of 4.0 ring class compounds; and (ii) ≤5.0 wt % of 4.5 ring class compounds or ≤3.0 wt % of 4.0 ring class compounds, based on the weight of the first hydroprocessed product.

In a particular embodiment, the first hydroprocessed product comprises one or more of the following: (a) about 1.0 wt % to about 20 wt %, preferably about 1.0 wt % to about 15 wt %, more preferably about 1.0 wt % to about 10 wt % of 1.0 ring class compounds; (b) about 5.0 wt % to about 50 wt %, preferably about 5.0 wt % to about 30 wt %, more preferably about 10 wt % to about 30 wt % of 1.5 ring class compounds; (c) about 10 wt % to about 60 wt %, preferably about 10 wt % to about 50 wt %, more preferably about 10 wt % to about 40 wt % of 2.0 ring class compounds; (d) about 10 wt % to about 50 wt %, preferably about 10 wt % to about 40 wt %, more preferably about 10 wt % to about 30 wt % of 2.5 ring class compounds; (e) about 1.0 wt % to about 30 wt %, preferably about 1.0 wt % to about 20 wt % of 3.0 ring class compounds; and/or (0 about 1.0 wt % to about 20 wt %, preferably about 1.0 wt % to about 15 wt %, more preferably about 1.0 wt % to about 10 wt % of 3.5 ring class compounds; wherein the weight percents are based on the weight of the first hydroprocessed product.

Additionally or alternatively, the first hydroprocessed product may comprise naphthenes. As used herein, the term "naphthene" refers to a cycloalkane (also known as a cycloparaffin) having from 3-30 carbon atoms. Examples of naphthenes include, but are not limited to cyclopropane, cyclobutane, cyclopentane, cyclohexane, cycloheptane, cyclooctane and the like. The term naphthene encompasses single-ring naphthenes and multi-ring naphthenes. The multi-ring naphthenes may have two or more rings, e.g., two-rings, three-rings, four-rings, five-rings, six-rings, seven-rings, eight-rings, nine-rings, and ten-rings. The rings may be fused and/or bridged. The naphthene can also include various side chains, particularly one or more alkyl side chains of 1-10 carbons. In particular, the first hydroprocessed product may comprise naphthenes having a single-ring (e.g., cyclopropane, cyclobutane, cyclopentane, cyclohexane, cycloheptane, cyclooctane, etc.) and/or having a double-ring (e.g., decahydronapthalene, octahydropentalene, etc.) in an amount of ≤5.0 wt %, ≤4.0 wt %, ≤3.0 wt %, ≤2.0 wt %, ≤1.5 wt %, ≤1.0 wt %, ≤0.75 wt %, ≤0.50 wt %, or about 0.10 wt %. For example, the first hydroprocessed product may comprise naphthenes having a single-ring in an amount of 0.10 wt % to 5.0 wt %, 0.10 wt % to 3.0 wt %, or 0.10 wt % to 1.0 wt %. Additionally or alternatively, the first hydroprocessed product may comprise naphthenes having a double-ring in an amount of 0.10 wt % to 5.0 wt %, 0.10 wt % to 3.0 wt %, 0.10 wt % to 2.0 wt % or 0.50 wt % to 1.5 wt %.

All of these multi-ring classes include ring compounds having hydrogen, alkyl, or alkenyl groups bound thereto, e.g., one or more of H, $CH_3$, $C_2H_5$ through $C_m H_{2m+1}$. Generally, m is in the range of from 1 to 6, e.g., from 1 to 5.

Additionally or alternatively, the first hydroprocessed product may have a suitable asphaltenes content that also may increase its compatibility with various residual fuel oils. For example, the first hydroprocessed product may have an asphaltenes content, based on total weight of the first hydroprocessed product, of ≤about 20 wt %, ≤about 15 wt %, ≤about 12 wt %, ≤about 10 wt %, ≤about 7.0 wt %, ≤about 5.0 wt %, ≤about 2.0 wt %, or about 1.0 wt %. Additionally or alternatively, the first hydroprocessed product may have an asphaltenes content, based on total weight of the first hydroprocessed product, of about 1.0 wt % to about 20 wt %, about 1.0 wt % to about 15 wt %, about 2.0 wt % to about 10 wt %, or about 2.0 wt % to about 7.0 wt %. Preferably, the first hydroprocessed product may have an asphaltenes content, based on total weight of the first hydroprocessed product of about 2.0 wt % to about 10 wt %.

As discussed above, the first hydroprocessed product may also have a variety of desirable properties. For example, the first hydroprocessed product may have a boiling point distribution of about 145° C. to about 760° C., as measured according to ASTM D6352. Further, the first hydroprocessed product may have a pour point, as measured according to ASTM D7346, ≤about 10° C., ≤about 5.0° C., ≤about 0.0° C., ≤about −5.0° C., ≤about −10° C., ≤about −15° C. or ≤about −20° C. Preferably, the first hydroprocessed product may have a pour point, as measured according to ASTM D7346, ≤about 0.0° C., more preferably ≤about −10° C. Additionally, or alternatively, the first hydroprocessed product may have pour point, as measured according to ASTM D7346, of about −30° C. to about 10° C., about −20° C. to about 10° C., about −20° C. to about 5.0° C., about −20° C. to about 0.0° C., or about −20° C. to about −5.0° C. Further, the first hydroprocessed product may have a kinematic viscosity at 50° C., as measured according to ASTM D7042, from about 20 $mm^2/s$ to about 200 $mm^2/s$, about 20 $mm^2/s$ to about 150 $mm^2/s$ or about 40 $mm^2/s$ to about 100 $mm^2/s$. This combination of aromaticity, viscosity and/or pour point embodied by the first hydroprocessed product renders it especially useful as a fuel oil blendstock, particularly for correcting off-spec fuel oils with respect to aromaticity, viscosity and/or pour point.

In various aspects, the first hydroprocessed product may further have one or more of the following:

(i) a Bureau of Mines Correlation Index (BMCI) of ≥about 80, ≥about 90, ≥about 100, or ≥about 110;

(ii) a solubility number ($S_n$) of ≥about 100, ≥about 110, ≥about 120, ≥about 130, or ≥about 140;

(iii) an energy content of ≥about 30 MJ/kg, ≥about 35 MJ/kg, or ≥about 40 MJ/kg; and (iv) a density at 15° C., as measured according to ASTM D4052, of about 0.99 g/ml to about 1.10 g/ml, particularly about 1.02 g/mL to about 1.08 g/ml.

B. Second Hydroprocessed Product

In various aspects, a second hydroprocessed product is provided herein. It is contemplated herein that the second hydroprocessed product is intended to encompass a product resultant from a second hydroprocessing zone or stage or a product resultant from a one or more stages of a multi-stage hydroprocess. In some embodiments, the second hydroprocessed product may be referred to as a second stage hydroprocessed product. Similar to the first hydroprocessed product, the second hydroprocessed product may comprise sulfur, paraffins and aromatics in suitable amounts and have desirable properties such as, but not limited to pour point and viscosity, such that the second hydroprocessed product may be a suitable fuel oil and/or a suitable fuel oil blendstock.

In particular, the second hydroprocessed product may have a sulfur content, based on total weight of the second hydroprocessed product, of ≤about 0.50 wt %, ≤about 0.40 wt %, ≤about 0.30 wt %, ≤about 0.20 wt %, ≤about 0.10 wt %, ≤about 0.080 wt %, or about 0.050 wt %. In particular, the second hydroprocessed product may have a sulfur content, based on total weight of the first hydroprocessed product, of ≤about 0.30 wt %, ≤about 0.20 wt %, or ≤about 0.10 wt %. Additionally or alternatively, the second hydroprocessed product may have a sulfur content, based on total weight of the second hydroprocessed product, of about 0.050 wt % to about 0.50 wt %, about 0.050 wt % to about 0.040 wt %, about 0.050 wt % to about 0.30 wt %, about 0.050 wt % to about 0.20 wt % or about 0.050 wt % to about 0.10 wt %. Advantageously, due its low sulfur content, the second hydroprocessed product may be suitable as an ULSFO and/or a LSFO. The second hydroprocessed product can also be used to extend the ULSFO pool and/or LSFO pool, which may permit the blending of LSFO with a ULSFO, blending of RSFO with a LSFO, and/or blending of a more viscous blendstock material with a LSFO or an ULSFO. Further, using the second hydroprocessed product as a blendstock can avoid the use a distillate, which may have an undesirably lower energy content. Additionally, the second hydroprocessed product may be used to correct ULSFO and/or LSFO, which may be off-spec with respect to sulfur content.

Additionally or alternatively, the second hydroprocessed product may have a lower paraffin content, which can advantageously lower the risk for wax precipitation and filter blocking in fuel systems. For example, the second hydroprocessed product may have a paraffin content, based on total weight of the second hydroprocessed product, of ≤about 10 wt %, ≤about 7.5 wt %, ≤about 5.0 wt %, ≤about 2.5 wt %, ≤about 1.0 wt %, ≤about 0.50 wt %, or about 0.10 wt %. Preferably, the second hydroprocessed product may have a paraffin content, based on total weight of the second hydroprocessed product, of ≤about 5.0 wt %, ≤about 2.5 wt %, ≤about 1.0 wt %, or ≤about 0.50 wt %. Additionally or alternatively, the second hydroprocessed product may have a paraffin content, based on total weight of the second hydroprocessed product, of about 0.10 wt % to about 10 wt %, about 0.10 wt % to about 5.0 wt %, about 0.10 wt % to about 1.0 wt %, or about 0.10 wt % to about 0.50 wt %.

Additionally or alternatively, the second hydroprocessed product may comprise a higher amount of aromatics, including alkyl-functionalized derivatives thereof rendering it more compatible with various residual fuel oils. For example, the second hydroprocessed product can comprise ≥40 wt %, ≥50 wt %, ≥60 wt %, ≥70 wt %, ≥80 wt %, ≥90 wt % or ≥95 wt % aromatics, including those having one or more hydrocarbon substituents, such as from 1 to 6 or 1 to 4 or 1 to 3 or 1 to 2 hydrocarbon substituents. Such substituents can be any hydrocarbon group that is consistent with the overall solvent distillation characteristics. Examples of such hydrocarbon groups include, but are not limited to, those selected from the group consisting of $C_1$-$C_6$ alkyl, wherein the hydrocarbon groups can be branched or linear and the hydrocarbon groups can be the same or different. Optionally, the second hydroprocessed product can comprises ≥90.0 wt % based on the weight of the second hydroprocessed product of one or more of benzene, ethylbenzene, trimethylbenzene, xylenes, toluene, naphthalenes, alkylnaphthalenes (e.g., methylnaphthalenes), tetralins, alkyltetralins (e.g., methyltetralins), phenanthrenes, or alkyl phenanthrenes.

It is generally desirable for the second hydroprocessed product to be substantially free of molecules having terminal unsaturates, for example, vinyl aromatics, particularly in embodiments utilizing a hydroprocessing catalyst having a tendency for coke formation in the presence of such molecules. The term "substantially free" in this context means that the second hydroprocessed product comprises ≤10.0 wt % (e.g., ≤5.0 wt % or ≤1.0 wt %) vinyl aromatics, based on the weight of the second hydroprocessed product.

Generally, the second hydroprocessed product contains sufficient amount of molecules having one or more aromatic cores. For example, the second hydroprocessed product can comprise ≥50.0 wt % of molecules having at least one aromatic core (e.g., ≥60.0 wt %, such as ≥70 wt %) based on the total weight of the second hydroprocessed product. In an embodiment, the second hydroprocessed product can comprise (i) ≥60.0 wt % of molecules having at least one aromatic core and (ii) ≤1.0 wt % of vinyl aromatics, the weight percents being based on the weight of the second hydroprocessed product.

The second hydroprocessed product will now be described in terms of moieties falling into distinct ring classes as described above as determined by two-dimensional gas chromatography (2D GC). Preferred, among each ring class described, are those moieties comprising at least one aromatic core.

The second hydroprocessed product may comprise 0.5, 1.0, 1.5, 2.0, 2.5, 3.0, 3.5, 4.0, 4.5, 5.0 and 5.5 ring class compounds. Preferably, the second hydroprocessed product can comprise ≤0.1 wt %, e.g., ≤0.05 wt %, such as ≤0.01 wt % total of 6.0, 6.5, and 7.0 ring class compounds, based on the weight of the utility fluid. Additionally, the second hydroprocessed product can include no 6.0, 6.5, and/or 7.0 ring class compounds. Alternatively, the second hydroprocessed product may comprise from 1.0 to 7.0 ring class compounds. Preferably, the second hydroprocessed product comprises from 1.0 to 5.5 ring class compounds. The second hydroprocessed product can further comprise ≤5.0 wt %, e.g., ≤3.0 wt %, ≤2.0 wt %, or ≤1.0 wt %, of non-aromatic ring compounds, such as naphthenes.

In various aspects, the second hydroprocessed product can comprise one or more of:

(i) ≥0.50 wt % of 1.0 ring class compounds or ≥1.0 wt % of 1.0 ring class compounds;

(ii) ≥1.0 wt % of 1.5 ring class compounds, ≥3.0 wt % of 1.5 ring class compounds, or ≥5.0 wt % of 1.5 ring class compounds;

(iii) ≥2.0 wt % of 2.0 ring class compounds, ≥5.0 wt % of 2.0 ring class compounds, or ≥10 wt % of 2.0 ring class compounds;

(iv) ≥5.0 wt % of 2.5 ring class compounds, ≥10 wt % of 2.5 ring class compounds, or ≥15 wt % of 2.5 ring class compounds;

(v) ≥5.0 wt % of 3.0 ring class compounds, ≥10 wt % of 3.0 ring class compounds, or ≥15 wt % of 3.0 ring class compounds;

(vi) ≥5.0 wt % of 3.5 ring class compounds, ≥10 wt % of 3.5 ring class compounds, or ≥12 wt % of 3.5 ring class compounds;

(vii) ≥2.0 wt % of 4.0 ring class compounds, ≥5.0 wt % of 4.0 ring class compounds, or ≥8.0 wt % of 4.0 ring class compounds;

(viii) ≥1.0 wt % of 4.5 ring class compounds, ≥2.0 wt % of 4.5 ring class compounds, or ≥4.0 wt % of 4.5 ring class compounds;

(ix) ≥1.0 wt % of 5.0 ring class compounds, or ≥2.0 wt % of 5.0 ring class compounds; and (x) ≥1.0 wt % of 5.5 ring class compounds, or ≥2.0 wt % of 5.5 ring class compounds; and based on the weight of the second hydroprocessed product.

Optionally, the second hydroprocessed product can comprise one or more of (i) ≤5.0 wt % of 1.0 ring class compounds or ≤3.0 wt % of 1.0 ring class compounds; and (ii) ≤5.0 wt % of 5.5 ring class compounds or ≤4.0 wt % of 5.5 ring class compounds, based on the weight of the second hydroprocessed product.

In a particular embodiment, the second hydroprocessed product comprises one or more of the following: (a) about 1.0 wt % to about 20 wt %, preferably about 1.0 wt % to about 15 wt %, more preferably about 1.0 wt % to about 8.0 wt % of 1.0 ring class compounds; (b) about 1.0 wt % to about 25 wt %, preferably about 1.0 wt % to about 20 wt %, more preferably about 1.0 wt % to about 15 wt % of 1.5 ring class compounds; (c) about 1.0 wt % to about 30 wt %, preferably about 1.0 wt % to about 25 wt %, more preferably about 1.0 wt % to about 20 wt % of 2.0 ring class compounds; (d) about 5.0 wt % to about 50 wt %, preferably about 10 wt % to about 40 wt %, more preferably about 10 wt % to about 30 wt % of 2.5 ring class compounds; (e) about 1.0 wt % to about 50 wt %, preferably about 5.0 wt % to about 40 wt %, more preferably about 5.0 wt % to about 30 wt % of 3.0 ring class compounds; (0 about 1.0 wt % to about 50 wt %, preferably about 5.0 wt % to about 40 wt %, more preferably about 5.0 wt % to about 30 wt % of 3.5 ring class compounds; (g) about 1.0 wt % to about 40 wt %, preferably about 1.0 wt % to about 30 wt %, more preferably about 1.0 wt % to about 20 wt % of 4.0 ring class compounds; (h) about 1.0 wt % to about 25 wt %, preferably about 1.0 wt % to about 20 wt %, more preferably about 1.0 wt % to about 15 wt % of 4.5 ring class compounds; (i) about 1.0 wt % to about 25 wt %, preferably about 1.0 wt % to about 20 wt %, more preferably about 1.0 wt % to about 15 wt % of 5.0 ring class compounds; and (j) about 1.0 wt % to about 25 wt %, preferably about 1.0 wt % to about 20 wt %, more preferably about 1.0 wt % to about 12 wt % of 5.5 ring class compounds wherein the weight percents are based on the weight of the second hydroprocessed product.

Additionally or alternatively, the second hydroprocessed product may comprise naphthenes as described herein. In particular, the second hydroprocessed product may comprise naphthenes having a single-ring (e.g., cyclopropane, cyclobutane, cyclopentane, cyclohexane, cycloheptane, cyclooctane, etc.) and/or having a double-ring (e.g., decahydronapthalene, octahydropentalene, etc.) in an amount of ≤5.0 wt %, ≤4.0 wt %, ≤3.0 wt %, ≤2.0 wt %, ≤1.5 wt %, ≤1.0 wt %, ≤0.75 wt %, ≤0.50 wt %, ≤0.10 wt %, or about 0.050 wt %. For example, the second hydroprocessed product may comprise naphthenes having a single-ring in an amount of 0.050 wt % to 5.0 wt %, 0.050 wt % to 1.0 wt %, 0.050 wt % to 0.50 wt %, or 0.050 wt % to 0.10 wt %. Additionally or alternatively, the second hydroprocessed product may comprise naphthenes having a double-ring in an amount of 0.10 wt % to 5.0 wt %, 0.10 wt % to 3.0 wt %, 0.10 wt % to 1.0 wt % or 0.10 wt % to 0.75 wt %.

All of these multi-ring classes include ring compounds having hydrogen, alkyl, or alkenyl groups bound thereto, e.g., one or more of H, $CH_3$, $C_2H_5$ through $C_m H_{2m+1}$. Generally, m is in the range of from 1 to 6, e.g., from 1 to 5.

Additionally or alternatively, the second hydroprocessed product may have a suitable asphaltenes content, which also may increase its compatibility with various residual fuel oils. For example, the second hydroprocessed product may have an asphaltenes content, based on total weight of the second hydroprocessed product, of ≤about 20 wt %, ≤about 15 wt %, ≤about 12 wt %, ≤about 10 wt %, ≤about 7.0 wt %, ≤about 5.0 wt %, ≤about 2.0 wt %, or about 1.0 wt %. Additionally or alternatively, the second hydroprocessed product may have an asphaltenes content, based on total weight of the second hydroprocessed product, of about 1.0 wt % to about 20 wt %, about 1.0 wt % to about 15 wt %, about 2.0 wt % to about 10 wt %, or about 2.0 wt % to about 7.0 wt %. Preferably, the second hydroprocessed product may have an asphaltenes content, based on total weight of the second hydroprocessed product of about 2.0 wt % to about 10 wt %.

As discussed above, the second hydroprocessed product may also have a variety of desirable properties. For example, the second hydroprocessed product may have a boiling point distribution of about 145° C. to about 760° C., as measured according to ASTM D6352. Further, the second hydroprocessed product may have a pour point, as measured according to ASTM D5949, ≤about 10° C., ≤about 5.0° C., ≤about 0.0° C., ≤about −5.0° C., ≤about −10° C., ≤about −15° C., ≤about −20° C., ≤about −25° C. or ≤about −30° C. Preferably, the second hydroprocessed product may have a pour point, as measured according to ASTM D5949, ≤about 0.0° C., more preferably ≤about −10° C., more preferably ≤about −20° C. Additionally, or alternatively, the second hydroprocessed product may have a pour point, as measured according to ASTM D5949, of about −30° C. to about 10° C., about −30° C. to about 5.0° C., about −30° C. to about 0.0° C., or about −20° C. to about 0.0° C. Further, the second hydroprocessed product may have a kinematic viscosity at 50° C., as measured according to ASTM D7042, from about 50 $mm^2/s$ to about 1000 $mm^2/s$, about 100 $mm^2/s$ to about 800 $mm^2/s$ or about 200 $mm^2/s$ to about 800 $mm^2/s$. This combination of aromaticity, viscosity and/or pour point embodied by the second hydroprocessed product renders it especially useful as a fuel oil blendstock, particularly for correcting off-spec fuel oils with respect to aromaticity, viscosity and/or pour point.

In various aspects, the second hydroprocessed product may further have one or more of the following:

(i) a Bureau of Mines Correlation Index (BMCI) of ≥about 80, ≥about 90, ≥about 100, or ≥about 110;

(ii) a solubility number ($S_n$) of ≥about 100, ≥about 110, ≥about 120, ≥about 130, ≥about 140, ≥about 150, ≥about 160, ≥about 170, ≥about 180, or ≥about 190;

(iii) an energy content of ≥about 30 MJ/kg, ≥about 35 MJ/kg, or ≥about 40 MJ/kg; and (iv) a density at 15° C., as measured according to ASTM D4052, of about 0.99 g/ml to about 1.10 g/ml, particularly about 1.02 g/mL to about 1.08 g/ml.

In various aspects, the second hydroprocessed product may meet the requirements of ISO 8217, Table 2 and qualify as a finished ULSFO and/or LSFO. In contrast, many ULSFOs currently available may be more paraffinic and contain no asphaltenes resulting in lower compatibility with other residual fuel oils as well as a higher risk of wax precipitation, which can cause filter blocking in a fuel system. Advantageously, the first and second hydroprocessed products have higher aromaticity (e.g., a higher BMCI), a suitable asphaltenes content and lower risk of wax precipitation.

II. Fuel Blends

Advantageously, the first and second hydroprocessed products can be used as fuel oil blendstocks and may be blended with various fuel streams to produce a suitable fuel blend. Thus, a fuel blend comprising (i) the first hydroprocessed product and/or the second hydroprocessed product and (ii) a fuel stream is provided herein.

Any suitable fuel stream may be used. Non-limiting examples of suitable fuel streams include a low sulfur diesel, an ultra low sulfur diesel, a low sulfur gas oil, an ultra low sulfur gas oil, a low sulfur kerosene, an ultra low sulfur kerosene, a hydrotreated straight run diesel, a hydrotreated straight run gas oil, a hydrotreated straight run kerosene, a hydrotreated cycle oil, a hydrotreated thermally cracked diesel, a hydrotreated thermally cracked gas oil, a hydrotreated thermally cracked kerosene, a hydrotreated coker diesel, a hydrotreated coker gas oil, a hydrotreated coker kerosene, a hydrocracker diesel, a hydrocracker gas oil, a hydrocracker kerosene, a gas-to-liquid diesel, a gas-to-liquid kerosene, a hydrotreated vegetable oil, a fatty acid methyl esters, a non-hydrotreated straight-run diesel, a non-hydrotreated straight-run kerosene, a non-hydrotreated straight-run gas oil, a distillate derived from low sulfur crude slates, a gas-to-liquid wax, gas-to-liquid hydrocarbons, a non-hydrotreated cycle oil, a non-hydrotreated fluid catalytic cracking slurry oil, a non-hydrotreated pyrolysis gas oil, a non-hydrotreated cracked light gas oil, a non-hydrotreated cracked heavy gas oil, a non-hydrotreated pyrolysis light gas oil, a non-hydrotreated pyrolysis heavy gas oil, a non-hydrotreated thermally cracked residue, a non-hydrotreated thermally cracked heavy distillate, a non-hydrotreated coker heavy distillates, a non-hydrotreated vacuum gas oil, a non-hydrotreated coker diesel, a non-hydrotreated coker gasoil, a non-hydrotreated coker vacuum gas oil, a non-hydrotreated thermally cracked vacuum gas oil, a non-hydrotreated thermally cracked diesel, a non-hydrotreated thermally cracked gas oil, a Group 1 slack wax, a lube oil aromatic extracts, a deasphalted oil, an atmospheric tower bottoms, a vacuum tower bottoms, a steam cracker tar, a residue material derived from low sulfur crude slates, an ultra low sulfur fuel oil (ULSFO), a low sulfur fuel oil (LSFO), regular sulfur fuel oil (RSFO), marine fuel oil, a hydrotreated residue material (e.g., residues from crude distillation), a hydrotreated fluid catalytic cracking slurry oil, and a combination thereof. In particular, the fuel stream may be a hydrotreated gas oil, a LSFO, a ULSFO and/or a marine fuel oil.

Optionally, if the first hydroprocessed product is intended for blending with a LSFO, the first hydroprocessed product may be further hydrotreated, if needed, to lower the sulfur content of the first hydroprocessed product, e.g., to <0.1 wt % sulfur, to meet emission control area (ECA) requirements. In particular, such ECA requirements must be followed for marine vessels operating with marine fuel oils.

In various aspects, the first hydroprocessed product and/or the second hydroprocessed product may be present in the fuel blend in an amount of about 40 wt % to about 70 wt % or about 50 wt % to about 60 wt %. Additionally, the fuel stream may be present in the fuel blend in an amount of about 30 wt % to about 60 wt % or about 40 wt % to about 50 wt %.

Advantageously, a fuel blend described herein may have a low sulfur content, a low pour point, a low viscosity and desirable energy content. In various aspects, the fuel blend may have a sulfur content of, based on total weight of the fuel blend, of ≤about 5.0 wt %, ≤about 2.5 wt %, ≤about 1.0 wt %, ≤about 0.75 wt %, ≤about 0.50 wt %, ≤about 0.40 wt %, ≤about 0.30 wt %, ≤about 0.20 wt %, ≤about 0.10 wt % or about 0.050 wt %. For example, the fuel blend may have a sulfur content, based on total weight of the fuel blend, of about 0.050 wt % to about 5.0 wt %, about 0.050 wt % to about 1.0 wt %, about 0.050 wt % to about 0.50 wt %, or about 0.050 wt % to about 0.10 wt %. Preferably, the fuel blend may have a sulfur content, based on total weight of the fuel blend, of ≤about 0.50 wt %.

Additionally or alternatively, the fuel blend may have a pour point, as measured according to ASTM D5950, ≤about 10° C., ≤about 5.0° C., ≤about 0.0° C., ≤about −5.0° C., ≤about −10° C., ≤about −15° C., ≤about −20° C., ≤about −30° C. or ≤about −40° C. Preferably, the fuel blend may have a pour point, as measured according to ASTM D5950, ≤about −5.0° C., more preferably ≤about −10° C. Additionally, or alternatively, the fuel blend may have a pour point, as measured according to ASTM D5950, of about −40° C. to about 10° C., about −40° C. to about 0.0° C., about −40° C. to about −5.0° C., or about −40° C. to about −10° C. Further, the fuel blend may have a kinematic viscosity at 50° C., as measured according to ASTM D7042, from about 5.0 $mm^2/s$ to about 200 $mm^2/s$, about 10 $mm^2/s$ to about 200 $mm^2/s$ or about 10 $mm^2/s$ to about 180 $mm^2/s$. Additionally or alternatively, the fuel blend may have an energy content of ≥about 30 MJ/kg, ≥about 35 MJ/kg, or ≥about 40 MJ/kg.

III. Methods for Lowering Pour Point of a Gas Oil

In another embodiment, methods of lowering the pour point of a gas oil are provided herein. The method of lowering the pour point of a gas oil may comprise blending a first hydroprocessed product as described herein and/or a second hydroprocessed product as described herein with a gas oil to form a blended gas oil. The blended gas oil may advantageously have a pour point lower than the pour point of the gas oil prior to blending with the first hydroprocessed product and/or the second hydroprocessed product. Thus, in various aspects, the pour point, as measured according ASTM D5950, of the gas oil prior to blending may be ≥about 0.0° C., ≥about 5.0° C., ≥about 10° C., ≥about 15° C., ≥about 20° C., ≥about 25° C., ≥about 30° C., ≥about 35°

C., ≥about 40° C., ≥about 45° C., ≥about 50° C., ≥about 55° C., or ≥about 60° C. For example, the pour point, as measured according ASTM D5950, of the gas oil prior to blending may be about 0.0° C. to about 60° C., about 0.0° C. to about 50° C., about 0.0° C. to about 40° C., or about 5.0° C. to about 40° C. Additionally, following blending with the first hydroprocessed product and/or the second hydroprocessed product, the blended gas oil may have a pour point, as measured according ASTM D5950, of ≤about 50° C., ≤about 40° C., ≤about 30° C., ≤about 20° C., ≤about 10° C., ≤about 0.0° C., ≤about −5.0° C., ≤about −10° C., ≤about −20° C., ≤about −30° C., ≤about −40° C., or ≤about −50° C. For example, the pour point, as measured according ASTM D5950, of the blended gas oil may be about −50° C. to about 50° C., about −50° C. to about 20° C., about −50° C. to about 0.0° C., about −50° C. to about −5.0° C., or about −40° C. to about 5.0° C. In a particular embodiment, the pour point of the gas oil prior to blending may be >0.0° C. and after blending the pour point of the blended gas oil may be <about −5.0° C., wherein the pour point of the gas oil and the blended gas oil are measured according to ASTM D5950.

Additionally or alternatively, a pour point of the blended gas oil may be at least about 5.0° lower than a pour point of the gas oil prior to blending, wherein the pour point of the gas oil and the blended gas oil are measured according to ASTM D5950. For example, a pour point of the blended gas oil may be at least about 10°, at least about 15°, at least about 20°, at least about 25°, at least about 30°, at least about 35°, at least about 40°, at least about 45°, at least about 50°, or at least about 55° lower than a pour point of the gas oil prior to blending, wherein the pour point of the gas oil and the blended gas oil are measured according to ASTM D5950. For example, a pour point of the gas oil may be about 25° C. and following blending with a first and/or a second hydroprocessed product, the resultant blended gas oil may have a pour point of −15° C.; thus, the pour point of the blended gas oil is 40° lower than the pour point of the gas oil.

Advantageously, blending of the first and/or second hydroprocessed product with a gas oil may not only lower the pour point of the gas oil, but may also not substantially negatively affect energy content, sulfur content and/or viscosity of the gas oil. In some aspects, blending of the first and/or second hydroprocessed product with a gas oil may substantially maintain and/or improve energy content, sulfur content and/or viscosity of the gas oil. Thus, in various aspects, the blended gas oil may have a sulfur content of, based on total weight of blended gas oil, of ≤about 5.0 wt %, ≤about 2.5 wt %, ≤about 1.0 wt %, ≤about 0.75 wt %, ≤about 0.50 wt %, ≤about 0.40 wt %, ≤about 0.30 wt %, ≤about 0.20 wt %, ≤about 0.10 wt % or about 0.050 wt %. For example, the blended gas oil may have a sulfur content, based on total weight of the blended gas oil, of about 0.050 wt % to about 5.0 wt %, about 0.050 wt % to about 1.0 wt %, about 0.050 wt % to about 0.50 wt %, or about 0.050 wt % to about 0.10 wt %. Preferably, the blended gas oil may have a sulfur content, based on total weight of the blended gas oil, of ≤about 0.50 wt % or ≤about 0.30 wt %. Further, the blended gas oil may have a kinematic viscosity at 50° C., as measured according to ASTM D7042, from about 5.0 $mm^2/s$ to about 200 $mm^2/s$, about 10 $mm^2/s$ to about 200 $mm^2/s$, about 10 $mm^2/s$ to about 180 $mm^2/s$, or about 10 $mm^2/s$ to about 100 $mm^2/s$. Additionally or alternatively, the blended gas oil may have an energy content of ≥about 30 MJ/kg, ≥about 35 MJ/kg, or ≥about 40 MJ/kg.

Suitable gas oils include, but are not limited to the fuel streams described herein. In particular, the gas oil may be off-spec marine gas oil, on-specification (on-spec) marine gas oil or hydrotreated gas oil. As used herein, the term "on-specification (on-spec) marine gas oil" may refer to marine gas oil according to ISO 8217 Table 1.

IV. Multistage Hydroprocessing for Producing the First and Second Hydroprocessed Products As discussed above, a hydrocarbon conversion process in which a feedstock comprising pyrolysis tar hydrocarbon (e.g., ≥10.0 wt %) and a utility fluid may be hydroprocessed in one or more hydroprocessing zones or stages (e.g., a first stage, a second stage) in the presence of a treat gas comprising molecular hydrogen under catalytic hydroprocessing conditions can produce a first hydroprocessed product as described herein and a second hydroprocessed product as described herein. Optionally, the utility fluid may be obtained during the process, for example, as a mid-cut stream from a first hydroprocessed product, for example, produced in a first stage hydroprocessing zone. The process may be operated at different temperatures in the one or more hydroprocessing stages or zones. In various aspects, the hydrocarbon conversion process is a solvent assisted tar conversion (SATC) process.

An SATC process is designed to convert tar, which may be a steam cracked tar or result from another pyrolysis process, into lighter products similar to fuel oil. In some cases, it is desirable to further upgrade the tar to have more molecules boiling in the distillate range. SATC is proven to be effective for drastic viscosity reduction from as high as 500,000 to 15 cSt at 50° C. with more than 90% sulfur conversion. The SATC reaction mechanism and kinetics are not straightforward due to the complex nature of tar, and due to the incompatibility phenomenon. The prominent reaction types in a SATC process are hydrocracking, hydro-desulfurization, hydro-denitrogenation, thermal cracking, hydrogenation and oligomerization reactions. It is very difficult to completely isolate these reactions from each other, but the selectivity of one reaction over the others can be increased by the selection of appropriate catalyst and process conditions. However thermodynamics and the required process conditions for these reactions can be very different, especially for thermal cracking and hydrogenation reactions. Achieving the target hydrotreated tar product quality in a single fixed bed reactor is very difficult due to the aforementioned differences in the nature of the reactions taking place in the SATC process. Moreover, if the reaction conditions are not selected properly, the SATC reactor can undergo premature plugging due to incompatibility. Unselective hydrogenation of molecules in the solvent range can reduce the solvency power of the feed and the precipitation of asphaltenes can occur when the difference between the solubility blend number and the insolubility number is reduced.

In general, the one or more stage process can be run at lower pressure and/or higher weight hour space velocity (WHSV) than a single stage while achieving similar or superior hydrogen penetration to upgrade the pyrolysis tar. These configurations can demonstrate advantages of a two hydroprocessing zone process that can include at least: i) a higher degree of penetration of input hydrogen into the desired hydroprocessing product is obtained at a lower operating pressure and higher space velocity; and ii) a lessening or prevention of saturation of the solvent (utility fluid) molecules which extends run length. Run length is believed to be extended by mitigating at least two fouling causes: i) lowered solvent $S_{BN}$ leading to precipitation of asphaltenes due to incompatibility, and ii) catalyst deactivation, most likely via accumulation of carbonaceous deposits. The process described herein may be performed such that the mid-cut stream produced has increased compatibility with pyrolysis tar, so that the mid-cut stream can be recycled and used as the utility fluid in at least a first hydroprocessing stage or zone to advantageously reduce viscosity of the feedstock and assist with flowability of the tar through the process.

Thus, in various aspects, a multi-stage hydrocarbon conversion process is provided herein. The hydrocarbon conversion process comprises: (a) hydroprocessing a feedstock comprising pyrolysis tar in a first hydroprocessing zone by contacting the feedstock with at least one hydroprocessing catalyst in the presence of a utility fluid and molecular hydrogen under catalytic hydroprocessing conditions to convert at least a portion of the feedstock to a first hydroprocessed product; (b) separating from the first hydroprocessed product in one or more separation stages: (i) an overhead stream comprising ≥about 1.0 wt % of the first hydroprocessed product; (ii) a mid-cut stream comprising ≥about 20 wt % of the first hydroprocessed product and having a boiling point distribution from about 120° C. to about 480° C. as measured according to ASTM D7500; and (iii) a bottoms stream comprising ≥about 20 wt % of the first hydroprocessed product; (c) recycling at least a portion of the mid-cut stream for use as the utility fluid in the first hydroprocessing zone; and (d) hydroprocessing at least a portion of the bottoms stream in a second hydroprocessing zone by contacting the bottoms stream with at least one hydroprocessing catalyst in the presence of molecular hydrogen under catalytic hydroprocessing conditions to convert at least a portion of the bottoms stream to a second hydroprocessed product.

A. Feedstock

The feedstock may comprise tar, e.g., ≥10 wt % tar hydrocarbon based on the weight of the feedstock, and can include >15 wt %, >20 wt %, >30 wt % or up to about 50 wt % tar hydrocarbon. In particular, the tar in the feedstock may be pyrolysis tar.

Pyrolysis tar in the feedstock can be produced by exposing a hydrocarbon-containing feed to pyrolysis conditions in order to produce a pyrolysis effluent, the pyrolysis effluent being a mixture comprising unreacted feed, unsaturated hydrocarbon produced from the feed during the pyrolysis, and pyrolysis tar. For example, a pyrolysis feedstock comprising ≥10 wt % hydrocarbon, based on the weight of the pyrolysis feedstock, is subjected to pyrolysis to produce a pyrolysis effluent, which generally contains pyrolysis tar and ≥1.0 wt % of $C_2$ unsaturates, based on the weight of the pyrolysis effluent. The pyrolysis tar generally comprises ≥90 wt % of the pyrolysis effluent's molecules having an atmospheric boiling point of ≥290° C. Thus, at least a portion of the pyrolysis tar is separated from the pyrolysis effluent to produce the feedstock for use in the multi-stage hydrocarbon conversion described herein, wherein the feedstock comprises ≥90 wt % of the pyrolysis effluent's molecules having an atmospheric boiling point of ≥290° C. Besides hydrocarbon, the pyrolysis feedstock optionally further comprises diluent, e.g., one or more of nitrogen, water, etc. For example, the pyrolysis feedstock may further comprise ≥1.0 wt % diluent based on the weight of the feed, such as ≥25.0 wt %. When the diluent includes an appreciable amount of steam, the pyrolysis is referred to as steam cracking. For the purpose of this description and appended claims, the following terms are defined.

The term "pyrolysis tar" means (a) a mixture of hydrocarbons having one or more aromatic components and optionally (b) non-aromatic and/or non-hydrocarbon molecules, the mixture being derived from hydrocarbon pyrolysis, with at least 70% of the mixture having a boiling point at atmospheric pressure that is ≥about 550° F. (290° C.). Certain pyrolysis tars have an initial boiling point ≥200° C. For certain pyrolysis tars, ≥90.0 wt % of the pyrolysis tar has a boiling point at atmospheric pressure ≥550° F. (290° C.). Pyrolysis tar can comprise, e.g., ≥50.0 wt %, e.g., ≥75.0 wt %, such as ≥90.0 wt %, based on the weight of the pyrolysis tar, of hydrocarbon molecules (including mixtures and aggregates thereof) having (i) one or more aromatic components and (ii) a number of carbon atoms ≥about 15. Pyrolysis tar generally has a metals content, $\leq 1.0\times10^3$ ppmw, based on the weight of the pyrolysis tar, which is an amount of metals that is far less than that found in crude oil (or crude oil components) of the same average viscosity. "SCT" means pyrolysis tar obtained from steam cracking, also referred to as steam-cracker tar.

"Tar Heavies" (TH) means a product of hydrocarbon pyrolysis, the TH having an atmospheric boiling point ≥565° C. and comprising ≥5.0 wt. % of molecules having a plurality of aromatic cores based on the weight of the product. The TH are typically solid at 25.0° C. and generally include the fraction of SCT that is not soluble in a 5:1 (vol.:vol.) ratio of n-pentane:SCT at 25.0° C. TH generally include asphaltenes and other high molecular weight molecules.

In various aspects, the pyrolysis tar can be a SCT-containing tar stream (the "tar stream") from the pyrolysis effluent. Such a tar stream typically contains ≥90 wt % of SCT based on the weight of the tar stream, e.g., ≥95 wt %, such as ≥99 wt %, with the balance of the tar stream being particulates, for example. A pyrolysis effluent SCT generally comprises ≥10 wt % (on a weight basis) of the pyrolysis effluent's TH.

In certain embodiments, a SCT comprises ≥50 wt % of the pyrolysis effluent's TH based on the weight of the pyrolysis effluent's TH. For example, the SCT can comprise ≥90 wt % of the pyrolysis effluent's TH based on the weight of the pyrolysis effluent's TH. The SCT can have, e.g., (i) a sulfur content in the range of 0.5 wt % to 7.0 wt %, based on the weight of the SCT; (ii) a TH content in the range of from 5.0 wt % to 40.0 wt %, based on the weight of the SCT; (iii) a density at 15° C. in the range of 1.01 g/cm$^3$ to 1.15 g/cm$^3$, e.g., in the range of 1.07 g/cm$^3$ to 1.15 g/cm$^3$; and (iv) a 50° C. viscosity in the range of 200 cSt to $1.0\times10^7$ cSt. The amount of olefin in a SCT is generally ≤10.0 wt %, e.g., ≤5.0 wt %, such as ≤2.0 wt %, based on the weight of the SCT. More particularly, the amount of (i) vinyl aromatics in a SCT and/or (ii) aggregates in a SCT that incorporates vinyl aromatics is generally ≤5.0 wt %, e.g., ≤3.0 wt %, such as ≤2.0 wt. %, based on the weight of the SCT.

In certain aspects, the hydrocarbon component of the pyrolysis feedstock can comprise ≥of one or more of naphtha, gas oil, vacuum gas oil, waxy residues, atmospheric residues, residue admixtures, or crude oil; including those comprising ≥about 0.1 wt % asphaltenes. For example, the hydrocarbon component of the pyrolysis feedstock comprises ≥10.0 wt %, e.g., ≥50.0 wt %, such as ≥90.0 wt % (based on the weight of the hydrocarbon) one or more of naphtha, gas oil, vacuum gas oil, waxy residues, atmospheric residues, residue admixtures, or crude oil; including those comprising ≥about 0.1 wt % asphaltenes. When the hydrocarbon includes crude oil and/or one or more fractions thereof, the crude oil is optionally desalted prior to being included in the pyrolysis feedstock. An example of a crude oil fraction utilized in the pyrolysis feedstock is produced by separating atmospheric pipestill ("APS") bottoms from a crude oil followed by vacuum pipestill ("VPS") treatment of the APS bottoms.

Suitable crude oils include, e.g., high-sulfur virgin crude oils, such as those rich in polycyclic aromatics. For example, the pyrolysis feedstock's hydrocarbon can include ≥90.0 wt % of one or more crude oils and/or one or more crude oil fractions, such as those obtained from an atmospheric APS and/or VPS; waxy residues; atmospheric residues; naphthas contaminated with crude; various residue admixtures; and SCT.

In some aspects, the tar in the pyrolysis effluent (e.g., a pyrolysis tar) can comprise (i) ≥10.0 wt % of molecules having an atmospheric boiling point ≥about 565° C. that are not asphaltenes, and (ii) ≤about $1.0\times10^3$ ppmw metals.

Alternatively, a tar stream can be obtained, e.g., from a steam cracked gas oil ("SCGO") stream and/or a bottoms stream of a steam cracker's primary fractionator, from flash-drum bottoms (e.g., the bottoms of one or more flash drums located downstream of the pyrolysis furnace and upstream of the primary fractionator), or a combination thereof. For example, the tar stream can be a mixture of primary fractionator bottoms and tar knock-out drum bottoms.

In various aspects, the tar in the feedstock (e.g., pyrolysis tar) has an $I_N$≥80. For example, the tar in the feedstock (e.g., pyrolysis tar) can have an $I_N$≥85, $I_N$≥90, $I_N$≥100 $I_N$≥110, $I_N$≥120, $I_N$≥130 or $I_N$≥135.

Additionally, the $S_{BN}$ of the tar in the feedstock (e.g., pyrolysis tar) can be as low as $S_{BN}$≥130, but is typically $S_{BN}$≥140, $S_{BN}$≥145, $S_{BN}$≥150, $S_{BN}$≥160, $S_{BN}$≥170, $S_{BN}$≥175 or even $S_{BN}$≥180. In some instances, the tar can be one having $S_{BN}$≥200, $S_{BN}$≥200, even an $S_{BN}$ about 240.

Further, the tar in the feedstock (e.g., pyrolysis tar) can include up to 50 wt % of C7 insolubles. Generally, the tar can have as much as 15 wt % C7 insolubles, or up to 25% C7 insolubles, or up to 30 wt % C7 insolubles, or up to 45% C7 insolubles. Thus, the tar may include from 15-50 wt % C7 insolubles, or 30-50 wt % C7 insolubles.

In particular, a tar to which the process can be advantageously applied is a pyrolysis tar having $I_N$ 110-135, $S_{BN}$ 180-240 and C7 insolubles content of 30-50 wt %.

B. Hydroprocessing Zones

"Hydroprocessing" refers to reactions that convert hydrocarbons from one composition of molecules to another in reactions that utilize molecular hydrogen. Hydroprocessing includes both cracking and hydrotreating.

"Cracking" is a process in which input hydrocarbon molecules, which might or might not include some heteroatoms, are converted to product hydrocarbon molecules of lower molecular weight. Cracking encompasses both "hydrocracking" in which hydrogen is included in the atmosphere contacting the reactants, and "thermal cracking," in which relatively high temperatures are used to drive reactions toward production of molecules at the low end of the molecular weight spectrum. Temperatures utilized in a hydrocracking process are typically lower than those used in a thermal cracking process. Cracking reactions may introduce unsaturated C—C bonds and increased aromaticity into a product compared to the hydrocarbon molecules input into the reaction. Desulfurization or deamination may also occur in cracking reactions. In "steam cracking," steam is included in the atmosphere of the cracking reaction.

"Hydrotreating" is a process in which bonds in a feedstock, typically unsaturated or aromatic carbon-carbon bonds in a hydrocarbon, are reduced by a hydrogenation reaction.

A catalyst will "promote predominantly" one reaction over another, in the context of the present application favoring cracking over hydrotreating or vice-versa, if the rate of the one reaction under a selected set of conditions of reactant concentration, temperature and pressure is increased by inclusion of the catalyst by a greater amount than the rate of the other reaction is increased by the presence of the catalyst under the same selected conditions.

As discussed above, a hydrocarbon conversion process, such as an SATC process, involves thermal cracking, hydrogenation, and desulfurization reactions. However, achieving the target hydrotreated tar product quality in a single reactor is very difficult due to the differences in the nature of those reactions and required process conditions needed during the SATC process. Additionally, a single reactor may experience premature plugging if the reaction conditions are not selected properly. Further, unselective hydrogenation of molecules in the solvent range can reduce the solvency power of the feed and the precipitation of asphaltenes can occur when the difference between the solubility blend number and the insolubility number is reduced.

These problems are solved, at least in part, by promoting the two main reactions, cracking and hydrogenation, in the at least two different reaction zones or stages in series. The two different reaction zones or stages are typically in two different reactors, but can be set up in two different parts of a single reactor. It will be appreciated that there can be more than two reaction zones or stages provided so long as there is at least one reaction zone or stage where cracking predominates and at least one reaction zone or stage where hydrotreating predominates. Even though cracking and hydrogenation reactions will take place in both reaction zones or stages, the bulk of these two reactions will take place in separate reaction zones or stages. Without being bound by any theory of the invention, it is believed that as a result, the solvency power of the liquid phase at reaction conditions will be high enough to keep the polar asphaltenes molecules in solution at any instant during the whole reaction time.

The multi-stage process enables the production of an on-spec SATC product (e.g. sulfur content 1.5 wt % or less, e.g. 1.0 wt % or less, or 0.5 wt % or less, and product viscosity as low as 30 cSt at 50° C. or less, preferably ≤20 cSt at 50° C. or ≤15 cSt at 50° C., and density ≤1.00 g/cm$^3$) from any type of tar, typically a steam cracked tar, for a sustainable duration of reactor life-time without plugging the reactor (e.g., 1 year or longer).

In most instances, the two main reactions, cracking (which may be either of hydrocracking or thermal cracking) and hydrogenation ("hydrotreating"), are promoted separately, that is, either of cracking or hydrogenation will predominate, in two different reaction zones or stages in series.

In some instances, thermal cracking and curing the cracked bonds with mild hydrogenation can be performed in one hydroprocessing zone or stage.

In some instances, hydrogenation can be carried out in another hydroprocessing zone or stage to pre-treat hard to convert tar samples (which are typically highly aromatic tar samples) or to boost the product quality, for example to reduce the product density.

A predominantly cracking reaction may precede a predominantly hydrogenation reaction, or vice-versa.

For example, a hydrocarbon conversion process may generally be one ("hydrotreating-cracking") comprising providing a feedstock as described herein and hydroprocessing the feedstock in at least two hydroprocessing zones or stages in the presence of a treat gas comprising molecular hydrogen under catalytic hydroprocessing conditions to produce a hydroprocessed product comprising hydroprocessed tar. In such instances, the hydroprocessing conditions are such that in a first hydroprocessing zone or stage a catalyst is used that promotes predominantly a hydrotreating reaction to produce a first hydroprocessed product, and in a second hydroprocessing zone, a catalyst is used that promotes predominantly a hydrocracking reaction to convert the first hydroprocessed product to the hydroprocessed product comprising hydroprocessed tar (the second hydroprocessed product).

Alternatively, a hydrocarbon conversion process can also be generally arranged as one ("cracking-hydrotreating") comprising providing a feedstock as described herein and hydroprocessing the feedstock in at least two hydroprocessing zones in the presence of a treat gas comprising molecular hydrogen under catalytic hydroprocessing conditions to produce a hydroprocessed product, comprising hydroprocessed tar. In such instances, the hydroprocessing conditions are such that in a first hydroprocessing zone a catalyst is used that promotes predominantly a hydrocracking reaction to produce a first hydroprocessed product, and in a second hydroprocessing zone, a catalyst is used that promotes predominantly a hydrotreating reaction to convert the first hydroprocessed product to the hydroprocessed product comprising hydroprocessed tar (the second hydroprocessed product).

Independently, or in combination with any particular arrangement of the catalysts in the different hydroprocessing zones or stages, the temperature in the first hydroprocessing zone or stage can range from about 200-450° C. or about 200-425° C. and the temperature in the hydroprocessing zone or stage can range from about 300-450° C. or about 350-425° C. and vice versa. In some instances, the temperature in the first hydroprocessing zone can be higher than the temperature in the second hydroprocessing zone and vice versa. Alternatively, the temperature may be the same in the first and second hydroprocessing zones or stages.

In any configuration of the process, the hydroprocessing conditions can comprise a pressure of from about 600-2000 psig, about 600-1900 psig, about 800-1600 psig, about 1000-1400 psig, about 1000-1200 psig, about 1100-1600 psig or about 1100-1300 psig. In some aspects, a pressure range of about 1000-1800 psig is typically used in a process in which a predominantly hydrotreating process is applied first, and a predominantly hydrocracking process is applied second.

In any configuration of the process, hydrogen ("makeup hydrogen") can be added to a feed or quench at a rate sufficient to maintain a $H_2$ partial pressure of from 700 psig to 1500 psig in a hydroprocessing zone.

In any configuration of the process, a catalyst promoting predominantly a hydrotreating reaction can comprise Ni and the pressure in the hydroprocessing zone or stage for predominantly a hydrotreating reaction can be ≥2000 psig.

In any configuration of the process, the tar in the feedstock (e.g., pyrolysis tar) can have $I_N \geq 100$ and (i) the hydrotreating can be conducted continuously in the hydrotreating zone or stage from a first time $t_1$ to a second time $t_2$, $t_2$ being $\geq(t_1+80$ days) and (ii) the pressure drop in the hydrotreating zone or stage at the second time increases ≤10.0% over the pressure drop at the first time.

In various aspects, the feedstock can be heated before the feedstock is hydroprocessed in the first hydroprocessing zone. For example, the feedstock can be mixed with a treat gas comprising molecular hydrogen and the mixture is heated, e.g., in a heat exchanger. The ratio of $H_2$:feed typically can be 3000 scfb, but may be varied, e.g. from about 2000 scfb to about 3500 scfb, or from about 2500-3200 scfb.

The mixed feed can then be further heated, usually to a temperature from 200° C. to 425° C., and is then fed into the first hydroprocessing zone The feed is contacted with a catalyst under catalytic hydroprocessing conditions as described herein to produce a first hydroprocessed product.

C. Utility Fluid

As discussed above, a utility fluid with improved compatibility with the tar (e.g., pyrolysis tar) can be advantageously obtained through use of at least two hydroprocessing zones or stages as described herein while also achieving a final product that can undergo more extensive hydrogenation to promote sulfur, density and viscosity reduction. In particular, the utility fluid may be obtained as a mid-cut stream separated from the first hydroprocessed product. Thus, the process provided herein includes separating the first hydroprocessed product in one or more separation stages into an overhead stream (also referred to as a light cut stream), a mid-cut stream and a bottoms stream. For example, the first hydroprocessed product may first be separated (e.g., in a flash drum) into a vapor portion and liquid portion, and the liquid portion may then be separated (e.g., in a distillation column) into the overhead stream, the mid-cut stream and the bottoms stream.

In various aspects, the overhead stream (or light cut stream) comprises ≥about 1.0 wt % (e.g., 5.0 wt %, 10 wt %, etc.) of the first hydroprocessed product, the mid-cut stream comprises ≥about 20 wt % (e.g., 30 wt %, 40 wt %, 50 wt %, etc.) of the first hydroprocessed product, and the bottoms stream comprises ≥about 20 wt % (e.g., 30 wt %, 40 wt %, etc.) of the first hydroprocessed product. For example, the overhead stream (or light cut stream) comprises from about 1.0 wt % to about 20 wt %, about 5.0 wt % to about 15 wt %, or about 5.0 wt % to about 10 wt % of the first hydroprocessed product. The mid-cut stream comprises from about 20 wt % to about 70 wt %, about 30 wt % to about 70 wt, or about 40 wt % to about 60 wt % of the first hydroprocessed product. The bottoms stream comprises from about 10 wt % to about 60 wt %, about 20 wt % to about 60 wt %, or about 30 wt % to about 50 wt % of the first hydroprocessed product.

In various embodiments, the overhead stream (or light cut stream) may have a boiling point distribution of about 140° C. to about 340° C., as measured according to ASTM D2887. Additionally or alternatively, the overhead stream (or light cut stream) may comprise aromatics (e.g., polycylic aromatics), based on total weight of the overhead stream (or light cut stream), in an amount ≥about 1.0 wt %, ≥about 5.0 wt %, ≥about 10 wt %, ≥about 15 wt %, ≥about 20 wt %, ≥about 30 wt %, or ≥about 40 wt %, e.g., about 1.0 wt % to about 40 wt %, about 1.0 wt % to about 30 wt %, about 1.0 wt % to about 20 wt %, about 1.0 wt % to about 15 wt %, about 5.0 wt % to about 40 wt %, about 5.0 wt % to about 30 wt %, about 5.0 wt % to about 20 or about 5.0 wt % to about 15 wt %.

Additionally or alternatively, the overhead stream (or light cut stream) may have a sulfur content, based on total weight of the overhead stream (or light cut stream), ≤about 100 ppm, ≤about 75 ppm≤about 50 ppm≤about 25 ppm, ≤about 20 ppm, ≤about 15 ppm, ≤about 10 ppm or ≤about 5.0 ppm. For example, the overhead stream (or light cut stream) may have a sulfur content, based on total weight of the overhead stream (or light cut stream), of about 5.0 ppm to about 100 ppm, about 5.0 ppm to about 75 ppm, about 5.0 ppm to about 50 ppm, about 5.0 ppm to about 25 ppm, about 5.0 ppm to about 20 ppm, about 5.0 ppm to about 15 ppm, or about 10 ppm to about 20 ppm.

Additionally or alternatively, the overhead stream (or light cut stream) may have a pour point, as measured according to ASTM D97, ≤about 10° C., ≤about 0.0° C., ≤about −10° C., ≤about −20° C., ≤about −30° C. <about −40° C., ≤about −50° C., ≤about −60° C. or ≤about −70° C. Preferably, the overhead stream (or light cut stream) may have a pour point, as measured according to ASTM D97, ≤about −30° C., more preferably ≤about −50° C., more preferably ≤about −60° C. Additionally, or alternatively, the overhead stream (or light cut stream) may have a pour point, as measured according to ASTM D97, of about −70° C. to about 10° C., about −70° C. to about 0.0° C., about −70° C. to about −20° C., or about −70° C. to about −40° C. Further, the overhead stream (or light cut stream) may have a viscosity at 40° C., as measured according to ASTM D445, from about 1.0 cSt to about 8.0 cSt, about 1.0 cSt to about 6.0 cSt, about 1.0 cSt to about 5.0 cSt, about 1.0 cSt to about 4.0 cSt, or about 1.0 cSt to about 3.0 cSt. Additionally or alternatively, the overhead stream (or light cut stream) may have one or more of the following: (i) a density at 15° C., as measured according to ASTM D4052, of about 910 kg/m$^3$ to about 960 kg/m$^3$; and (ii) a cetane index, as measured according to ASTM D4737, of about 10 to about 20.

The bottoms stream may be optionally mixed with fresh treat gas (in the manner described above) and is contacted with at least one hydroprocessing catalyst as described herein under catalytic hydroprocessing conditions to convert at least a portion of the bottoms stream to a second hydroprocessed product. The bottoms stream, optionally with the fresh treat gas may be heated, e.g., in a heat exchanger, and/or then introduced into the second hydroprocessing zone or stage and contacted with at least hydroprocessing catalyst under catalytic hydroprocessing conditions to convert at least a portion of the bottoms stream to the second hydroprocessed product. Optionally, at least a portion of the overhead stream may be blended with the second hydroprocessed product. In various aspects, the weight hourly space velocity (WHSV) of the feedstock through the first hydroprocessing zone or stages and/or the bottoms stream through the second hydroprocessing zone or stage may be about 0.5 hr$^{-1}$ to about 4.0 hr$^{-1}$, preferably about 0.7 hr' to about 4.0 hr$^{-1}$.

Compatibility of a utility fluid and tar is based on comparing the $S_{BN}$ of a mixture of the utility fluid and tar with the $I_N$ of the tar. For example, for SCT, a utility fluid may be considered compatible with SCT, if a mixture of utility fluid and SCT has an $S_{BN}$ value >than the SCT's $I_N$ value. In other words, if an SCT has an $I_N$ of 80, a mixture of a utility fluid and the SCT would be considered compatible if the mixture of the utility fluid and the SCT has an $S_{BN}$ of >80, ≥90, ≥100, ≥110 or ≥120.

However, a mid-cut stream's $S_{BN}$ can be affected by hydroprocessing conditions. For example, as conditions are adjusted to (e.g., higher pressure, lower WHSV) to improve the product quality, the mid-cut stream may become further hydrogenated, which may reduce the mid-cut stream's $S_{BN}$. A reduced $S_{BN}$ of the mid-cut stream can be problematic when blending with the tar because a lower $S_{BN}$ can render the mid-cut stream incompatible with the tar, which can lead to fouling and plugging of the reactor.

It was discovered that a process using at least two hydroprocessing zones, where the mid-cut stream is separated from the first hydroprocessed zone or stage as described herein can produce a mid-cut stream having a composition and a boiling range rendering it especially useful as a utility fluid in various hydrocarbon conversion process, e.g., hydroprocessing. In particular, the mid-cut stream advantageously has increased compatibility with the tar (e.g., pyrolysis tar) in the feedstock. Due to increased compatibility with the tar, when the mid-cut stream is used during hydroprocessing as the utility fluid, there may be significantly less fouling in the hydroprocessing reactor and ancillary equipment, resulting in increased hydroprocessing run length. In various aspects, the mid-cut stream has an $S_{BN}$ of ≥about 100, ≥about 110, ≥about 120, ≥about 130, ≥about 140, ≥150, or ≥160.

Optionally, at least a portion of the mid-cut stream can then be recycled (i.e., interstage recycle) for use as the utility fluid in the first hydroprocessing zone. For example, ≥about 20 wt %, ≥about 30 wt %, ≥about 40 wt %, ≥about 50 wt %, ≥about 60 wt %, ≥about 70 wt %, ≥about 80 wt % of the mid-cut stream may be recycled for use as the utility fluid in the first hydroprocessing zone or stage.

It is observed that a supplemental utility fluid may be needed under certain operating conditions, e.g., when starting the process (until sufficient utility fluid is available from the first hydroprocessed product as the mid-cut stream), or when operating at higher reactor pressures.

Accordingly, a supplemental utility fluid, such as a solvent, a solvent mixture, steam cracked naphtha (SCN), steam cracked gas oil (SCGO), or a fluid comprising aromatics (i.e., comprises molecules having at least one aromatic core) may optionally be added, e.g., to start-up the process. In certain aspects, the supplemental utility fluid comprises ≥50.0 wt %, e.g., ≥75.0 wt %, such as ≥90.0 wt % of aromatics and/or non-aromatics, based on the weight of the supplemental utility fluid. The supplemental utility fluid can have an ASTM D86 10% distillation point ≥60° C. and a 90% distillation point ≤350° C. Optionally, the utility fluid (which can be a solvent or mixture of solvents) has an ASTM D86 10% distillation point >120° C., e.g., ≥140° C., such as ≥150° C. and/or an ASTM D86 90% distillation point ≤300° C.

Optionally, the supplemental utility fluid may comprise ≥90.0 wt. % based on the weight of the utility fluid of one or more of benzene, ethylbenzene, trimethylbenzene, xylenes, toluene, naphthalenes, alkylnaphthalenes (e.g., methylnaphthalenes), tetralins, or alkyltetralins (e.g., methyltetralins), e.g., ≥95.0 wt %, such as ≥99.0 wt %. It is generally desirable for the supplemental utility fluid to be substantially free of molecules having alkenyl functionality, particularly in aspects utilizing a hydroprocessing catalyst having a tendency for coke formation in the presence of such molecules. In certain aspects, the supplemental utility fluid comprises ≤10.0 wt. % of ring compounds having $C_1$-$C_6$ sidechains with alkenyl functionality, based on the weight of the utility fluid. One suitable supplemental utility fluid is A200 solvent, available from ExxonMobil Chemical Company (Houston Tex.) as Aromatic 200, CAS number 64742-94-5.

The relative amounts of utility fluid (e.g., mid-cut stream, supplemental utility fluid) and tar stream employed during hydroprocessing are generally in the range of from about 20.0 wt % to about 95.0 wt % of the tar stream and from about 5.0 wt % to about 80.0 wt % of the utility fluid, based on total weight of the combined utility fluid and tar stream. For example, the relative amounts of utility fluid (e.g., mid-cut stream, supplemental utility fluid) and tar stream during hydroprocessing can be in the range of (i) about 20.0 wt % to about 90.0 wt % of the tar stream and about 10.0 wt % to about 80.0 wt % of the utility fluid, or (ii) from about 40.0 wt % to about 90.0 wt % of the tar stream and from about 10.0 wt % to about 60.0 wt % of the utility fluid. In one embodiment, the utility fluid (e.g., mid-cut stream, supplemental utility fluid): tar weight ratio can be ≥0.01, e.g., in the range of 0.05 to 4.0, such as in the range of 0.1 to 3.0, or 0.3 to 1.1. At least a portion of the utility fluid (e.g., mid-cut stream, supplemental utility fluid) can be combined with at least a portion of the tar stream within the first hydroprocessing vessel or first hydroprocessing zone or stage, but this is not required, and in one or more embodiments at least a portion of the utility fluid (e.g., mid-cut stream, supplemental utility fluid) and at least a portion of the tar stream are supplied as separate streams and combined into one feed stream prior to entering (e.g., upstream of) the hydroprocessing stage(s). For example, the tar stream and utility fluid (e.g., mid-cut stream, supplemental utility fluid) can be combined to produce a feedstock upstream of the hydroprocessing stage (e.g., first hydroprocessing zone), the feedstock comprising, e.g., (i) about 20.0 wt % to about 90.0 wt % of the tar stream and about 10.0 wt % to about 80.0 wt % of the utility fluid (e.g., mid-cut stream, supplemental utility fluid), or (ii) from about 40.0 wt % to about 90.0 wt % of the tar stream and from about 10.0 wt % to about 60.0 wt % of the utility fluid (e.g., mid-cut stream, supplemental utility fluid), the weight percents being based on the weight of the feedstock.

In some embodiments, the mixture of utility fluid (e.g., mid-cut stream, supplemental utility fluid) and pyrolysis tar has an $S_{BN}$ value about 20 points >an $I_N$ of the pyrolysis tar. For example, in such instances, where the pyrolysis tar has an $I_N$>80, the mixture of utility fluid and pyrolysis tar has an $S_{BN}$ of at least ≥100. Particularly, the mixture of utility fluid (e.g., mid-cut stream, supplemental utility fluid) and pyrolysis tar has an $S_{BN}$ value about 30 points >an $I_N$ of the pyrolysis tar or the mixture of utility fluid and pyrolysis tar has an $S_{BN}$ value about 40 points >an $I_N$ of the pyrolysis tar.

In some embodiments, the mixture of utility fluid (e.g., mid-cut stream, supplemental utility fluid) and pyrolysis tar has an SBN≥110. Thus, it has been found that there is a beneficial decrease in reactor plugging when hydroprocessing pyrolysis tars having incompatibility number ($I_N$)>80 if, after being combined, the utility fluid (e.g., mid-cut stream, supplemental utility fluid) and tar mixture has an $S_{BN}$≥110, ≥120, ≥130. Additionally, it has been found that there is a beneficial decrease in reactor plugging when hydroprocessing pyrolysis tars having $I_N$>110 if, after being combined, the utility fluid (e.g., mid-cut stream, supplemental utility fluid) and tar mixture has an $S_{BN}$≥150, ≥155, or ≥160.

Generally, the mid-cut stream, which is useful as a utility fluid, comprises to a large extent a mixture of multi-ring compounds. The rings can be aromatic or non-aromatic and can contain a variety of substituents and/or heteroatoms. For example, the mid-cut stream can contain ≥10.0 wt %, ≥20.0 wt %, ≥30.0 wt %, ≥40.0 wt %, ≥45.0 wt %, ≥50.0 wt %, ≥55.0 wt %, or ≥60.0 wt %, based on the weight of the mid-cut stream, of aromatic and/or non-aromatic ring compounds.

The mid-cut stream can have a boiling point distribution of about 120° C. to about 480° C. as measured according to ASTM D7500. Additionally or alternatively, the mid-cut stream may comprise aromatics (e.g., polycylic aromatics), based on total weight of the mid-cut stream, in an amount ≥about 10 wt %, ≥about 20 wt %, ≥about 30 wt %, ≥about 40 wt %, ≥about 50 wt %, ≥about 60 wt %, ≥about 70 wt %, ≥about 80 wt %, ≥about 90 wt % or ≥about 95 wt %, e.g., about 10 wt % to about 95 wt %, about 20 wt % to about 95 wt %, about 30 wt % to about 95 wt %, about 50 wt % to about 95 wt %, about 50 wt % to about 95 wt %, about 60 wt % to about 95 wt %, about 10 wt % to about 60 wt %, about 20 wt % to about 60 wt %, about 30 wt % to about 60 wt % or about 30 wt % to about 50 wt %.

Additionally or alternatively, the mid-cut stream may have a sulfur content, based on total weight of the mid-cut stream, ≤about 3000 ppm, ≤about 2500 pmm≤about 2000 ppm≤about 1500 ppm, ≤about 1000 ppm, or ≤about 500 ppm. For example, the mid-cut stream may have a sulfur content, based on total weight of the mid-cut stream, of about 500 ppm to about 3000 ppm, about 500 ppm to about 2500 ppm, about 500 ppm to about 2000 ppm, about 500 ppm to about 1500 ppm, about 1000 ppm to about 3000 ppm, about 1000 ppm to about 2000 ppm, or about 1000 ppm to about 1500 ppm.

Additionally or alternatively, the mid-cut stream may have a pour point, as measured according to ASTM D97, ≤about 10° C., ≤about 0.0° C., ≤about −10° C., ≤about −20° C., ≤about −30° C. ≤about −40° C., ≤about −50° C., or ≤about −60° C. Preferably, the mid-cut stream may have a pour point, as measured according to ASTM D97, ≤about −20° C., more preferably ≤about −30° C., more preferably ≤about −40° C. Additionally, or alternatively, the mid-cut stream may have a pour point, as measured according to ASTM D97, of about −60° C. to about 10° C., about −60° C. to about 0.0° C., about −60° C. to about −10° C., or about −60° C. to about −20° C. Further, the mid-cut stream may have a viscosity at 40° C., as measured according to ASTM D445, from about 1.0 cSt to about 12 cSt, about 1.0 cSt to about 10 cSt, about 1.0 cSt to about 8.0 cSt, about 2.0 cSt to about 8.0 cSt, about 3.0 cSt to about 7.0 cSt or about 4.0 cSt to about 6.0 cSt. Additionally or alternatively, the mid-cut stream may have a cetane index, as measured according to ASTM D4737, of about 7 to about 20.

In some embodiments, the mid-cut stream may have a composition and properties as described in ExxonMobil Chemical Company's application titled Multi-Stage Upgrading of Hydrocarbon Pyrolysis Tar Using Recycled Interstage Product U.S. application Ser. No. 16/025,622 filed on Jul. 2, 2018, which is incorporated herein by reference in its entirety.

D. Catalysts

Conventional hydroprocessing catalysts can be utilized for hydroprocessing the feedstock (e.g., pyrolysis tar) as described herein in the at least two hydroprocessing zones or stages as described herein. Suitable hydroprocessing catalysts for use in the at least two hydroprocessing zones or stages include those comprising (i) one or more bulk metals and/or (ii) one or more metals on a support. The metals can be in elemental form or in the form of a compound. In one or more embodiments, the hydroprocessing catalyst includes at least one metal from any of Groups 5 to 10 of the Periodic Table of the Elements (tabulated as the Periodic Chart of the Elements, The Merck Index, Merck & Co., Inc., 1996). Examples of such catalytic metals include, but are not limited to, vanadium, chromium, molybdenum, tungsten, manganese, technetium, rhenium, iron, cobalt, nickel, ruthenium, palladium, rhodium, osmium, iridium, platinum, or mixtures thereof.

In one or more embodiments, the catalyst has a total amount of Groups 5 to 10 metals per gram of catalyst of at least 0.0001 grams, or at least 0.001 grams or at least 0.01 grams, in which grams are calculated on an elemental basis. For example, the catalyst can comprise a total amount of Group 5 to 10 metals in a range of from 0.0001 grams to 0.6 grams, or from 0.001 grams to 0.3 grams, or from 0.005 grams to 0.1 grams, or from 0.01 grams to 0.08 grams. In a particular embodiment, the catalyst further comprises at least one Group 15 element. An example of a preferred Group 15 element is phosphorus. When a Group 15 element is utilized, the catalyst can include a total amount of elements of Group 15 in a range of from 0.000001 grams to 0.1 grams, or from 0.00001 grams to 0.06 grams, or from 0.00005 grams to 0.03 grams, or from 0.0001 grams to 0.001 grams, in which grams are calculated on an elemental basis.

In an embodiment, the catalyst comprises at least one Group 6 metal. Examples of preferred Group 6 metals include chromium, molybdenum and tungsten. The catalyst may contain, per gram of catalyst, a total amount of Group 6 metals of at least 0.00001 grams, or at least 0.01 grams, or at least 0.02 grams, in which grams are calculated on an elemental basis. For example, the catalyst can contain a total amount of Group 6 metals per gram of catalyst in the range of from 0.0001 grams to 0.6 grams, or from 0.001 grams to 0.3 grams, or from 0.005 grams to 0.1 grams, or from 0.01 grams to 0.08 grams, the number of grams being calculated on an elemental basis.

In related embodiments, the catalyst includes at least one Group 6 metal and further includes at least one metal from Group 5, Group 7, Group 8, Group 9, or Group 10. Such catalysts can contain, e.g., the combination of metals at a molar ratio of Group 6 metal to Group 5 metal in a range of from 0.1 to 20, 1 to 10, or 2 to 5, in which the ratio is on an elemental basis. Alternatively, the catalyst can contain the combination of metals at a molar ratio of Group 6 metal to a total amount of Groups 7 to 10 metals in a range of from 0.1 to 20, 1 to 10, or 2 to 5, in which the ratio is on an elemental basis.

When the catalyst includes at least one Group 6 metal and one or more metals from Groups 9 or 10, e.g., molybdenum-cobalt and/or tungsten-nickel, these metals can be present, e.g., at a molar ratio of Group 6 metal to Groups 9 and 10 metals in a range of from 1 to 10, or from 2 to 5, in which the ratio is on an elemental basis. When the catalyst includes at least one of Group 5 metal and at least one Group 10 metal, these metals can be present, e.g., at a molar ratio of Group 5 metal to Group 10 metal in a range of from 1 to 10, or from 2 to 5, where the ratio is on an elemental basis. Additionally, the catalyst may further comprise inorganic oxides, e.g., as a binder and/or support. For example, the catalyst can comprise (i) ≥1.0 wt % of one or more metals selected from Groups 6, 8, 9, and 10 of the Periodic Table and (ii) ≥1.0 wt % of an inorganic oxide, the weight percents being based on the weight of the catalyst.

In one or more embodiments, the catalyst (e.g., in the first and/or second hydroprocessing zone) is a bulk multimetallic hydroprocessing catalyst with or without binder. In an embodiment the catalyst is a bulk trimetallic catalyst comprised of two Group 8 metals, preferably Ni and Co and one Group 6 metal, preferably Mo.

This disclosure also include incorporating into (or depositing on) a support one or catalytic metals e.g., one or more metals of Groups 5 to 10 and/or Group 15, to form the hydroprocessing catalyst. The support can be a porous material. For example, the support can comprise one or more refractory oxides, porous carbon-based materials, zeolites, or combinations thereof suitable refractory oxides include, e.g., alumina, silica, silica-alumina, titanium oxide, zirconium oxide, magnesium oxide, and mixtures thereof. Suitable porous carbon-based materials include activated carbon and/or porous graphite. Examples of zeolites include, e.g., Y-zeolites, beta zeolites, mordenite zeolites, ZSM-5 zeolites, and ferrierite zeolites. Additional examples of support materials include gamma alumina, theta alumina, delta alumina, alpha alumina, or combinations thereof. The amount of gamma alumina, delta alumina, alpha alumina, or combinations thereof, per gram of catalyst support, can be in a range of from 0.0001 grams to 0.99 grams, or from 0.001 grams to 0.5 grams, or from 0.01 grams to 0.1 grams, or at most 0.1 grams, as determined by x-ray diffraction. In a particular embodiment, the hydroprocessing catalyst (e.g., in the first and/or second hydroprocessing zone) is a supported catalyst, and the support comprises at least one alumina, e.g., theta alumina, in an amount in the range of from 0.1 grams to 0.99 grams, or from 0.5 grams to 0.9 grams, or from 0.6 grams to 0.8 grams, the amounts being per gram of the support. The amount of alumina can be determined using, e.g., x-ray diffraction. In alternative embodiments, the support can comprise at least 0.1 grams, or at least 0.3 grams, or at least 0.5 grams, or at least 0.8 grams of theta alumina.

When a support is utilized, the support can be impregnated with the desired metals to form the hydroprocessing catalyst. The support can be heat-treated at temperatures in a range of from 400° C. to 1200° C., or from 450° C. to 1000° C., or from 600° C. to 900° C., prior to impregnation with the metals. In certain embodiments, the hydroprocessing catalyst can be formed by adding or incorporating the Groups 5 to 10 metals to shaped heat-treated mixtures of support. This type of formation is generally referred to as overlaying the metals on top of the support material. Optionally, the catalyst is heat treated after combining the support with one or more of the catalytic metals, e.g., at a temperature in the range of from 150° C. to 750° C., or from 200° C. to 740° C., or from 400° C. to 730° C. Optionally, the catalyst is heat treated in the presence of hot air and/or oxygen-rich air at a temperature in a range between 400° C. and 1000° C. to remove volatile matter such that at least a portion of the Groups 5 to 10 metals are converted to their corresponding metal oxide. In other embodiments, the catalyst can be heat treated in the presence of oxygen (e.g., air) at temperatures in a range of from 35° C. to 500° C., or from 100° C. to 400° C., or from 150° C. to 300° C. Heat treatment can take place for a period of time in a range of from 1 to 3 hours to remove a majority of volatile components without converting the Groups 5 to 10 metals to their metal oxide form. Catalysts prepared by such a method are generally referred to as "uncalcined" catalysts or "dried." Such catalysts can be prepared in combination with a sulfiding method, with the Groups 5 to 10 metals being substantially dispersed in the support. When the catalyst comprises a theta alumina support and one or more Groups 5 to 10 metals, the catalyst is generally heat treated at a temperature ≥400° C. to form the hydroprocessing catalyst. Typically, such heat treating is conducted at temperatures ≤1200° C.

In one or more embodiments, the hydroprocessing catalysts usually include transition metal sulfides dispersed on high surface area supports. The structure of the typical hydrotreating catalysts is made of 3-15 wt % Group 6 metal oxide and 2-8 wt % Group 8 metal oxide and these catalysts are typically sulfided prior to use.

The catalyst can be in shaped forms, e.g., one or more of discs, pellets, extrudates, etc., though this is not required. Non-limiting examples of such shaped forms include those having a cylindrical symmetry with a diameter in the range of from about 0.79 mm to about 3.2 mm ($1/32^{nd}$ to $1/8^{th}$ inch), from about 1.3 mm to about 2.5 mm ($1/20^{th}$ to $1/10^{th}$ inch), or from about 1.3 mm to about 1.6 mm ($1/20^{th}$ to $1/16^{th}$ inch). Similarly-sized non-cylindrical shapes are also contemplated herein, e.g., trilobe, quadralobe, etc. Optionally, the catalyst has a flat plate crush strength in a range of from 50-500 N/cm, or 60-400 N/cm, or 100-350 N/cm, or 200-300 N/cm, or 220-280 N/cm.

Porous catalysts, including those having conventional pore characteristics, are within the scope of the invention. When a porous catalyst is utilized, the catalyst can have a pore structure, pore size, pore volume, pore shape, pore surface area, etc., in ranges that are characteristic of conventional hydroprocessing catalysts, though the invention is not limited thereto. Since feedstock (e.g., pyrolysis tar) can consist of fairly large molecules, catalysts with large pore size are preferred, especially at reactor locations where the catalyst and feed first meet. For example, the catalyst can have a median pore size that is effective for hydroprocessing SCT molecules, such catalysts having a median pore size in the range of from 30 Å to 1000 Å, or 50 Å to 500 Å, or 60 Å to 300 Å. Further, catalysts with bi-modal pore system, having 150-250 Å pores with feeder pores of 250-1000 Å in the support are more favorable. Pore size can be determined according to ASTM Method D4284-07 Mercury Porosimetry.

In a particular embodiment, the hydroprocessing catalyst (e.g., in the first and/or second hydroprocessing zone) has a median pore diameter in a range of from 50 Å to 200 Å. Alternatively, the hydroprocessing catalyst has a median pore diameter in a range of from 90 Å to 180 Å, or 100 Å to 140 Å, or 110 Å to 130 Å. In another embodiment, the hydroprocessing catalyst has a median pore diameter ranging from 50 Å to 150 Å. Alternatively, the hydroprocessing catalyst has a median pore diameter in a range of from 60 Å to 135 Å, or from 70 Å to 120 Å. In yet another alternative, hydroprocessing catalysts having a larger median pore diameter are utilized, e.g., those having a median pore diameter in a range of from 180 Å to 500 Å, or 200 Å to 300 Å, or 230 Å to 250 Å.

Generally, the hydroprocessing catalyst has a pore size distribution that is not so great as to significantly degrade catalyst activity or selectivity. For example, the hydroprocessing catalyst can have a pore size distribution in which at least 60% of the pores have a pore diameter within 45 Å, 35 Å, or 25 Å of the median pore diameter. In certain embodiments, the catalyst has a median pore diameter in a range of from 50 Å to 180 Å, or from 60 Å to 150 Å, with at least 60% of the pores having a pore diameter within 45 Å, 35 Å, or 25 Å of the median pore diameter.

When a porous catalyst is utilized, the catalyst can have, e.g., a pore volume ≥0.3 $cm^3/g$, such ≥0.7 $cm^3/g$, or ≥0.9 $cm^3/g$. In certain embodiments, pore volume can range, e.g., from 0.3 $cm^3/g$ to 0.99 $cm^3/g$, 0.4 $cm^3/g$ to 0.8 $cm^3/g$, or 0.5 $cm^3/g$ to 0.7 $cm^3/g$.

In certain embodiments, a relatively large surface area can be desirable. As an example, the hydroprocessing catalyst can have a surface area ≥60 $m^2/g$, or ≥100 $m^2/g$, or ≥120 $m^2/g$, or ≥170 $m^2/g$, or ≥220 $m^2/g$, or ≥270 $m^2/g$; such as in the range of from 100 $m^2/g$ to 300 $m^2/g$, or 120 $m^2/g$ to 270 $m^2/g$, or 130 $m^2/g$ to 250 $m^2/g$, or 170 $m^2/g$ to 220 $m^2/g$.

Conventional hydroprocessing catalysts for use in the hydroprocessing zones can be used, but the invention is not limited thereto. In certain embodiments, the catalysts include one or more of KF860 and RT series series catalysts available from Albemarle Catalysts Company LP, Houston Tex.; Nebula® Catalyst, such as Nebula® 20, available from the same source; Centera® catalyst, available from Criterion Catalysts and Technologies, Houston Tex., such as one or more of DC-2618, DN-2630, DC-2635, and DN-3636; Ascent® Catalyst, available from the same source, such as one or more of DC-2532, DC-2534, and DN-3531; FCC pre-treat catalyst, such as DN3651 and/or DN3551, available from the same source; and TK series catalysts, available from Haldor Topsoe, Lyngby, Denmark, such as one or more of TK-565 HyBRIM™, TK-611 HyBRIM™, and TK-926. However, the invention is not limited to only these catalysts.

Hydroprocessing the specified amounts of tar stream and utility fluid using the specified hydroprocessing catalyst and specified utility fluid leads to improved catalyst life, e.g., allowing the hydroprocessing stage to operate for at least 3 months, or at least 6 months, or at least 1 year without replacement of the catalyst in the hydroprocessing or contacting zones. Catalyst life is generally >10 times longer than would be the case if no utility fluid were utilized, e.g., ≥100 times longer, such as ≥1000 times longer.

In a particular embodiment, when the process is run in the hydrotreating-cracking configuration, the catalyst in the first hydroprocessing zone or stage can be one that comprises one or more of Co, Fe, Ru, Ni, Mo, W, Pd, and Pt, supported on amorphous $Al_2O_3$ and/or $SiO_2$ (ASA). Exemplary catalysts for use in a hydroprocessing zone, which hydroprocessing can be the first treatment applied to the feedstock tar, are a Ni—Co—Mo/$Al_2O_3$ type catalyst, or Pt—Pd/$Al_2O_3$—$SiO_2$, Ni—W/$Al_2O_3$, Ni—Mo/$Al_2O_3$, or Fe, Fe—Mo supported on a non-acidic support such as carbon black or carbon black composite, or Mo supported on a nonacidic support such as $TiO_2$ or $Al_2O_3/TiO_2$.

The catalyst in the second hydroprocessing zone or stage can be one that comprises predominantly one or more of a zeolite or Co, Mo, P, Ni, Pd supported on ASA and/or zeolite. Exemplary catalysts for use in the second hydroprocessing zone are USY or VUSY Zeolite Y, Co—Mo/$Al_2O_3$, Ni—Co—Mo/$Al_2O_3$, Pd/ASA-Zeolite Y. The catalyst for each hydroprocessing zone or stage maybe selected independently of the catalyst used in any other hydroprocessing zone or stage; for example, RT-228 catalyst may be used in the first hydroprocessing zone or stage, and RT-621 catalyst may be used in the second hydroprocessing zone or stage.

In some aspects, a guard bed comprising an inexpensive and readily available catalyst, such as Co—Mo/$Al_2O_3$, followed by $H_2S$ and $NH_3$ removal is needed if the S and N content of the feed is too high and certain catalysts are used in the hydroprocessing zone (e.g., a zeolite). However, the guard bed may not be necessary when a zeolite catalyst is used in the second reactor because the sulfur and nitrogen levels will already be reduced in the first reactor. Steps for $NH_3$ and $H_2S$ separation can still be applied to the products of both of the first hydroprocessing zone or stage and the second hydroprocessing zone or stage if desired.

In another particular embodiment, when run in the cracking-hydrotreating manner, the catalyst in the first hydroprocessing zone or stage can be one that comprises predominantly one or more of a zeolite or Co, Mo, P, Ni, Pd supported on ASA and/or zeolite, and the catalyst in the second hydroprocessing zone can be one that comprises one or more of Ni, Mo, W, Pd, and Pt, supported on amorphous $Al_2O_3$ and/or $SiO_2$ (ASA). In this configuration, the exemplary catalysts for use in the first hydroprocessing zone or stage are USY or VUSY Zeolite Y, Co—Mo/$Al_2O_3$, Ni—Co—Mo/$Al_2O_3$, Pd/ASA-Zeolite Y and exemplary catalysts for use in the second hydroprocessing zone or stage are a Ni—Co—Mo/$Al_2O_3$ type catalyst, or Pt—Pd/$Al_2O_3$—

$SiO_2$, Ni—W/$Al_2O_3$, Ni—Mo/$Al_2O_3$, or Fe, Fe—Mo supported on a non-acidic support such as carbon black or carbon black composite, or Mo supported on a nonacidic support such as $TiO_2$ or $Al_2O_3/TiO_2$. The catalyst in the second hydroprocessing zone or stage can be one that comprises one or more of Co, Fe, Ru, Ni, Mo, W, Pd, and Pt, supported on amorphous $Al_2O_3$ and/or $SiO_2$ (ASA). Exemplary catalysts for use in a hydroprocessing zone, which hydroprocessing can be the first treatment applied to the feedstock tar, are a Ni—Co—Mo/$Al_2O_3$ type catalyst, or Pt—Pd/$Al_2O_3$—$SiO_2$, Ni—W/$Al_2O_3$, Ni—Mo/$Al_2O_3$, or Fe, Fe—Mo supported on a non-acidic support such as carbon black or carbon black composite, or Mo supported on a nonacidic support such as $TiO_2$ or $Al_2O_3/TiO_2$.

The catalyst for each hydroprocessing zone maybe selected independently of the catalyst used in any other hydroprocessing zone or stage; for example, RT-621 catalyst may be used in the first hydroprocessing zone or stage, and RT-228 catalyst may be used in the second hydroprocessing zone or stage.

V. Further Embodiments

Embodiment 1

A first hydroprocessed product comprising aromatics in an amount ≥about 50 wt % or ≥about 80 wt %; paraffins in an amount ≤about 5.0 wt %; sulfur in an amount from about 0.10 wt % to ≤0.50 wt; and optionally, asphaltenes in an amount from about 2.0 wt % to 10 wt %; wherein the first hydroprocessed product has: a boiling point distribution of about 145° C. to about 760° C. as measured according to ASTM D6352; a pour point of ≤about 0.0° C. or ≤−10° C., as measured according to ASTM D7346 and a kinematic viscosity at 50° C. from 20 $mm^2/s$ to 200 $mm^2/s$, as measured according to ASTM D7042.

Embodiment 2

The first hydroprocessed product of Embodiment 1, wherein the first hydroprocessed product comprises one or more of: (a) ≥1.0 wt % of 1.0 ring class compounds; (b) ≥10 wt % of 1.5 ring class compounds; (c) ≥20 wt % of 2.0 ring class compounds; (d) ≥15 wt % of 2.5 ring class compounds; and (e) ≥5.0 wt % of 3.0 ring class compounds; based on the weight of the first hydroprocessed product.

Embodiment 3

The first hydroprocessed product of Embodiment 1 or 2 having one or more of the following: (i) a Bureau of Mines Correlation Index (BMCI) of ≥about 100; (ii) a solubility number ($S_n$) of ≥about 130; and (iii) an energy content of ≥about 35 MJ/kg.

Embodiment 4

A second hydroprocessed product comprising: aromatics in an amount ≥about 50 wt % or ≥about 80 wt %.; paraffins in an amount ≤about 5.0 wt %; sulfur in an amount ≤0.30 wt %; and optionally, asphaltenes in an amount from about 2.0 wt % to 10 wt %; wherein the second hydroprocessed product has: a boiling point distribution of about 140° C. to about 760° C. as measured according to ASTM D6352; a pour point of ≤about 0.0° C., as measured according to ASTM D5949 and a kinematic viscosity at 50° C. from 100 $mm^2/s$ to 800 $mm^2/s$, as measured according to ASTM D7042.

Embodiment 5

The second hydroprocessed product of Embodiment 4, wherein the second hydroprocessed product comprises one or more of: (a) ≥1.0 wt % of 1.0 ring class compounds; (b) ≥5.0 wt % of 1.5 ring class compounds; (c) ≥5.0 wt % of 2.0 ring class compounds; (d) ≥10 wt % of 2.5 ring class compounds; (e) ≥10 wt % of 3.0 ring class compounds; and (f) 10 wt % of 3.5 ring class compounds; based on the weight of the second hydroprocessed product.

Embodiment 6

The second hydroprocessed product of Embodiment 4 or 5 having one or more of the following: (i) a Bureau of Mines Correlation Index (BMCI) of ≥about 100; (ii) a solubility number ($S_n$) of ≥about 150; and (iii) an energy content of ≥about 35 MJ/kg.

Embodiment 7

A fuel blend comprising: the first hydroprocessed product of any one of Embodiments 1 to 3 and/or the second hydroprocessed product of any one Embodiments 4 to 6; and a fuel stream.

Embodiment 8

The fuel blend of Embodiment 7, wherein the fuel stream is selected from the group consisting of a low sulfur diesel, an ultra low sulfur diesel, a low sulfur gas oil, an ultra low sulfur gas oil, a low sulfur kerosene, an ultra low sulfur kerosene, a hydrotreated straight run diesel, a hydrotreated straight run gas oil, a hydrotreated straight run kerosene, a hydrotreated cycle oil, a hydrotreated thermally cracked diesel, a hydrotreated thermally cracked gas oil, a hydrotreated thermally cracked kerosene, a hydrotreated coker diesel, a hydrotreated coker gas oil, a hydrotreated coker kerosene, a hydrocracker diesel, a hydrocracker gas oil, a hydrocracker kerosene, a gas-to-liquid diesel, a gas-to-liquid kerosene, a hydrotreated vegetable oil, a fatty acid methyl esters, a non-hydrotreated straight-run diesel, a non-hydrotreated straight-run kerosene, a non-hydrotreated straight-run gas oil, a distillate derived from low sulfur crude slates, a gas-to-liquid wax, gas-to-liquid hydrocarbons, a non-hydrotreated cycle oil, a non-hydrotreated fluid catalytic cracking slurry oil, a non-hydrotreated pyrolysis gas oil, a non-hydrotreated cracked light gas oil, a non-hydrotreated cracked heavy gas oil, a non-hydrotreated pyrolysis light gas oil, a non-hydrotreated pyrolysis heavy gas oil, a non-hydrotreated thermally cracked residue, a non-hydrotreated thermally cracked heavy distillate, a non-hydrotreated coker heavy distillates, a non-hydrotreated vacuum gas oil, a non-hydrotreated coker diesel, a non-hydrotreated coker gasoil, a non-hydrotreated coker vacuum gas oil, a non-hydrotreated thermally cracked vacuum gas oil, a non-hydrotreated thermally cracked diesel, a non-hydrotreated thermally cracked gas oil, a Group 1 slack wax, a lube oil aromatic extracts, a deasphalted oil, an atmospheric tower bottoms, a vacuum tower bottoms, a steam cracker tar, a residue material derived from low sulfur crude slates, an ultra low sulfur fuel oil (ULSFO), a low sulfur fuel oil (LSFO), regular sulfur fuel oil (RSFO), a marine fuel oil, a hydrotreated residue material, a hydrotreated fluid catalytic cracking slurry oil, and a combination thereof.

Embodiment 9

The fuel blend of Embodiment 7 or 8, wherein the first hydroprocessed product and/or the second hydroprocessed product is present in an amount of about 40 wt % to about 70 wt %, and the fuel stream is present in an amount of about 30 wt % to about 60 wt %.

Embodiment 10

The fuel blend of any one of Embodiments 7 to 9, wherein the fuel blend comprises sulfur in an amount <about 0.50 wt % and has: a pour point of ≤about −5.0° C., as measured according to ASTM D5950; a kinematic viscosity at 50° C. from 10 $mm^2/s$ to 180 $mm^2/s$, as measured according to ASTM D7042; and an energy content of ≥about 35 MJ/kg.

Embodiment 11

A method of lowering pour point of a gas oil comprising blending the first hydroprocessed product of any one of Embodiments 1 to 3 and/or the second hydroprocessed product of any one Embodiments 4 to 6 with a gas oil (e.g., off-spec marine gas oil, on-spec marine gas oil or hydrotreated gas oil) to form a blended gas oil, which has a pour point lower than the pour point of the gas oil.

Embodiment 12

The method of Embodiment 11, wherein the pour point of the gas oil prior to blending is ≥0.0° C. and after blending the pour point of the blended gas oil is ≤about −5.0° C. and/or wherein the blended gas oil has a pour point at least 5° C. lower than the pour point of the gas oil prior to blending.

Embodiment 13

The method of Embodiment 11 or 12, wherein the blended gas oil comprises sulfur in an amount <about 0.50 wt % or <about 0.30 wt % and has: a kinematic viscosity at 50° C. from 10 $mm^2/s$ to 180 $mm^2/s$, as measured according to ASTM D7042; and an energy content of ≥about 35 MJ/kg.

EXAMPLES

General Methods

A. Two-Dimensional Gas Chromatography

The 2D GC (GC×GC) system utilized was an Agilent 7890 gas chromatograph (Agilent Technology, Wilmington, Del.) configured with inlet, columns, and detectors. A split/splitless inlet system with a sixteen-vial tray autosampler was used. The two-dimensional capillary column system utilized a weak-polar first column (BPX-5, 30 meter, 0.25 mm I.D., 1.0 μm film), and a mid-polar second column (BPX-50, 3 meter, 0.10 mm I.D., 0.10 μm film). Both capillary columns were obtained from SGE Inc. Austin, Tex. A ZX1, looped single jet thermal modulation assembly (ZOEX Corp. Lincoln, Nebr.) which is a cold nitrogen gas cooled (liquid nitrogen heat exchanged) "trap-release" thermal modulator was installed between these two columns. The output of GC×GC was split into two streams, one connected to a flame ionization detector (FID) and the other one connected to the ion source of MS via transfer line. The MS was a JMS-T100GCV 4G (JEOL, Tokyo, Japan), time-of-flight spectrometer (TOFMS) system (mass resoltuioon 8000 (FWHM) and a mass accuracy specification of 5 ppm), equipped with either an electrion ionization (EI) or field ionization (FI) source. The switch between EI mode and FI mode can be achieved within 5 minutes by using a probe to exchange without venting the ion source. The maximum sampling rate was up to 50 Hz, which was sufficient to meet the required sampling rate for preserving GC×GC resolution.

A 0.20 microliter sample was injected via a split/splitless (S/S) injector with 50:1 split at 300° C. in constant flow mode of 2.0 mL per minute helium. The oven was programmed from 45° C. to 315° C. at 3° C. per minute for a total run time of 90 minutes. The hot jet was kept at 120° C. above the oven temperature and then constant at 390° C. The MS transfer line and ion source were set at 350° C. and 150° C., respectively. The modulation period was 10 seconds. The sampling rate for the FID detector was 100 Hz and for mass spectrometer (both EI and FI mode) was 25 Hz. An Agilent Chemstation provided GC×GC control and data acquisition of FID. JEOL Mass Center software was used for MS control data acquisition. The synchronization between GC×GC and MS was made using a communication cable from the GC remote control port to the MS external synchronization port. After data was acquired, the FID, EIMS and FIMS signals were processed for qualitative and quantitative analysis and the EIMS and FIMS data was processed.

Example 1—First Hydroprocessed Products

Example 1a: First Hydroprocessed Product I

Composition and property details for a First Hydroprocessed Product I were determined and are shown in Table 1 below.

TABLE 1

| First Hydroprocessed Product I | | | |
|---|---|---|---|
| Characteristic | Method | Unit | Result |
| Properties | | | |
| Kinematic Viscosity @ 50° C. | D7042 | $mm^2/s$ | 61.073 |
| Density at 60° F. | D4052 | g/ml | 1.0466 |
| Density at 15° C. | Calculated (assuming thermal expansion coefficient = 0.0007/° C.) | g/ml | 1.046 |
| Solubility number | AMS 99-011 | — | 142 |
| Insolubility number | AMS 99-011 | — | 93 |
| BMCI | Calculated | — | 115.7 |
| Asphaltenes | D6560 (estimated from carbon residue) | wt % | 5.3 |
| CCAI | Calculated | — | 929 |
| Micro Carbon Residue | D4530 | mass % | 8.00 |
| Flash Point | D6450 | ° C. | 111 |
| Pour Point | D5949 | ° C. | −37 |
| | D7346 | ° C. | −18 |
| Energy content (net) | Calculated (estimated by ISO8217, Annex E. 0.10 vol % water and 0.01% wt ash) | MJ/kg | 40.2 |
| | Calculated | BTU/gal | 150865 |

TABLE 1-continued

| First Hydroprocessed Product I | | | |
|---|---|---|---|
| Characteristic | Method | Unit | Result |
| Composition | | | |
| Sulfur | D2622 | mass % | 0.461 |
| Carbon | D5291 | mass % | 90.1 |
| Hydrogen | D5291 | mass % | 8.62 |
| Nitrogen | D5291 | mass % | 0.10 |
| Paraffins | 2D GC* | wt % | 0.03 |
| Naphthene - single ring | 2D GC* | wt % | 0.33 |
| Naphthene - double ring | 2D GC* | wt % | 1.30 |
| Total naphthenes | Calculated | wt % | 1.63 |
| Aromatics - 1 ring class | 2D GC* | wt % | 4.17 |
| Aromatics - 1.5 ring class | 2D GC* | wt % | 14.47 |
| Aromatics - 2 ring class | 2D GC* | wt % | 15.31 |
| Aromatics - 2.5 ring class | 2D GC* | wt % | 14.67 |
| Aromatics - 3 ring class | 2D GC* | wt % | 14.58 |
| Aromatics - 3.5 ring class | 2D GC* | wt % | 13.42 |
| Aromatics - 4 ring class | 2D GC* | wt % | 9.50 |
| Aromatics - 4.5 ring class | 2D GC* | wt % | 9.68 |
| Aromatics - 5 ring class | 2D GC* | wt % | 1.76 |
| Aromatics - 5.5 ring class | 2D GC* | wt % | 0.78 |
| Total aromatics | Calculated | wt % | 98.34 |
| Distillation | | | |
| T0.5 | D6352 | ° F. | 339 |
| T5 | D6352 | ° F. | 431 |
| T10 | D6352 | ° F. | 471 |
| T20 | D6352 | ° F. | 517 |
| T30 | D6352 | ° F. | 566 |
| T40 | D6352 | ° F. | 621 |
| T50 | D6352 | ° F. | 684 |
| T60 | D6352 | ° F. | 753 |
| T70 | D6352 | ° F. | 834 |
| T80 | D6352 | ° F. | 940 |
| T90 | D6352 | ° F. | 1088 |
| T95 | D6352 | ° F. | 1184 |
| T99.5 | D6352 | ° F. | 1330 |

*2D GC was measured for portion of First Hydroprocessed Product I with a boiling point up to 1050° F.

Example 1b: First Hydroprocessed Product II

Composition and property details for a First Hydroprocessed Product II were determined and are shown in Table 2 below.

TABLE 2

| First Hydroprocessed Product II | | | |
|---|---|---|---|
| Characteristic | Method | Unit | Result |
| Properties | | | |
| Density at 60° F. | D4052 | g/ml | 1.0167 |
| Density at 15° C. | Calculated | g/ml | 1.017 |
| Solubility number | AMS 99-011 | — | |
| Insolubility number | AMS 99-011 | — | |
| BMCI | Calculated | — | 109.1 |

TABLE 2-continued

| First Hydroprocessed Product II | | | |
|---|---|---|---|
| Characteristic | Method | Unit | Result |
| Asphaltenes | D6560 (estimated from carbon residue) | wt % | 3.8 |
| Micro Carbon Residue | D4530 | mass % | 5.66 |
| Energy content (net) | Calculated (estimated by ISO8217, Annex E. 0.10 vol % water and 0.01% wt ash) | MJ/kg | 40.8 |
| | Calculated | BTU/gal | 148946 |
| Composition | | | |
| Sulfur | D2622 | mass % | 0.251 |
| Carbon | D5291 | mass % | 89.7 |
| Hydrogen | D5291 | mass % | 9.10 |
| Nitrogen | D5291 | mass % | <0.10 |
| Composition for components with boiling point < 550° F. | | | |
| Sulfur | D2622 | mass % | 0.0127 |
| Nitrogen | D5762 | ppm m/m | 40 |
| Paraffins | 2D GC | wt % | 0.72 |
| Naphthene - single ring | 2D GC | wt % | 1.27 |
| Naphthene - double ring | 2D GC | wt % | 3.52 |
| Total naphthenes | Calculated | wt % | 4.79 |
| Aromatics - 1 ring class | 2D GC | wt % | 13.23 |
| Aromatics - 1.5 ring clas | 2D GC | wt % | 40.56 |
| Aromatics - 2 ring class | 2D GC | wt % | 31.96 |
| Aromatics - 2.5 ring class | 2D GC | wt % | 7.89 |
| Aromatics - 3 ring class | 2D GC | wt % | 0.79 |
| Aromatics - 3.5 ring class | 2D GC | wt % | 0.07 |
| Aromatics - 4 ring class | 2D GC | wt % | 0.00 |
| Aromatics - 4.5 ring class | 2D GC | wt % | 0.00 |
| Aromatics - 5 ring class | 2D GC | wt % | 0.00 |
| Aromatics - 5.5 ring class | 2D GC | wt % | 0.00 |
| Total aromatics | Calculated | wt % | 94.49 |
| Composition for components with 550° F. < boiling point < 950° F. | | | |
| Sulfur | D2622 | mass % | 0.230 |
| Hydrogen | D7171 | mass % | 9.3 |
| Nitrogen | D5762 | ppm m/m | 405 |
| Paraffins | 2D GC | wt % | 0.30 |
| Naphthene - single ring | 2D GC | wt % | 0.53 |
| Naphthene - double ring | 2D GC | wt % | 1.25 |
| Total naphthenes | Calculated | wt % | 1.78 |
| Aromatics - 1 ring class | 2D GC | wt % | 5.14 |
| Aromatics - 1.5 ring clas | 2D GC | wt % | 18.35 |
| Aromatics - 2 ring class | 2D GC | wt % | 30.01 |
| Aromatics - 2.5 ring class | 2D GC | wt % | 21.82 |
| Aromatics - 3 ring class | 2D GC | wt % | 11.38 |
| Aromatics - 3.5 ring class | 2D GC | wt % | 6.35 |
| Aromatics - 4 ring class | 2D GC | wt % | 2.75 |

TABLE 2-continued

| First Hydroprocessed Product II | | | |
|---|---|---|---|
| Characteristic | Method | Unit | Result |
| Aromatics - 4.5 ring class | 2D GC | wt % | 1.84 |
| Aromatics - 5 ring class | 2D GC | wt % | 0.27 |
| Aromatics - 5.5 ring class | 2D GC | wt % | 0.01 |
| Total aromatics | Calculated | wt % | 97.93 |
| Distillation | | | |
| T0.5 | D6352 | ° F. | 318 |
| T5 | D6352 | ° F. | 434 |
| T10 | D6352 | ° F. | 475 |
| T20 | D6352 | ° F. | 512 |
| T30 | D6352 | ° F. | 537 |
| T40 | D6352 | ° F. | 561 |
| T50 | D6352 | ° F. | 586 |
| T60 | D6352 | ° F. | 616 |
| T70 | D6352 | ° F. | 673 |
| T80 | D6352 | ° F. | 795 |
| T90 | D6352 | ° F. | 992 |
| T95 | D6352 | ° F. | 1143 |
| T99.5 | D6352 | ° F. | 1346 |
| Composition for components with boiling point > 950° F. | | | |
| Sulfur | D2622 | mass % | 0.59 |
| Carbon | D5291 | mass % | 91.1 |
| Hydrogen | D5291 | mass % | 7.22 |
| Nitrogen | D5291 | mass % | 0.12 |

The distribution of aromatic rings in the First Hydroprocessed Product II having a boiling point greater than 510° C. (950° F.) was determined and is shown FIG. 1 where the x-axis represent the number of aromatic rings and the y-axis represents % mass. The distribution of aromatic rings in the First Hydroprocessed Product II having a boiling point greater than 510° C. (950° F.) was determined by using a 15T Solarix Fourier Transform Ion Cyclotron Resonance Mass Spectrometry (FT-ICR-MS). Atmospheric pressure photon ionization (APPI) was employed which utilizes a krypton lamp to ionizes the molecules in the gas phase that are then guided through various electronic lenses to the ICR cell for detection. Calibrated data yields an exact mass which in turn provides a unique stoichiometric formula for each assigned mass in the entire mass spectrum. Based on the unique formula homologs arranged by their hydrogen deficiency and rings are calculated with the exclusive assumption of aromatic rings.

Example 1c: First Hydroprocessed Product III

Composition and property details for a First Hydroprocessed Product III were determined and are shown in Table 3 below.

TABLE 3

| First Hydroprocessed Product III | | | |
|---|---|---|---|
| Characteristic | Method | Unit | Result |
| Properties | | | |
| Kinematic Viscosity @ 40° C. | D7042 | $mm^2/s$ | 64.287 |
| Kinematic Viscosity @ 100° C. | D7042 | $mm^2/s$ | 5.8630 |
| Kinematic Viscosity @ 50° C. | D341 | $mm^2/s$ | 36.577 |

TABLE 3-continued

| First Hydroprocessed Product III | | | |
|---|---|---|---|
| Characteristic | Method | Unit | Result |
| Density at 60° F. | D4052 | g/ml | 1.0357 |
| Density at 15° C. | Calculated | g/ml | 1.0361 |
| Solubility number | AMS 99-011 | — | 139 |
| Insolubility number | AMS 99-011 | — | 87 |
| BMCI | Calculated | — | 113 |
| Asphaltenes | D6560 (estimated from carbon residue) | wt % | 4.6 |
| CCAI | Calculated | — | 925 |
| Micro Carbon Residue | D4530 | mass % | 6.87 |
| Flash Point | D6450 | ° C. | 102.4 |
| Pour Point | D5950 | ° C. | −27 |
| Energy content (net) | Calculated (estimated by ISO8217, Annex E. 0.10 vol % water and 0.01% wt ash) | MJ/kg | 40.4 |
| | Calculated | BTU/gal | 150055 |
| Composition | | | |
| Sulfur | D2622 | mass % | 0.401 |
| Carbon | D5291 | mass % | 90.5 |
| Hydrogen | D5291 | mass % | 8.74 |
| Nitrogen | D5291 | mass % | <0.10 |
| Distillation | | | |
| T0.5 | M1567 | ° F. | 275 |
| T5 | M1567 | ° F. | 402 |
| T10 | M1567 | ° F. | 445 |
| T20 | M1567 | ° F. | 507 |
| T30 | M1567 | ° F. | 562 |
| T40 | M1567 | ° F. | 608 |
| T50 | M1567 | ° F. | 658 |
| T60 | M1567 | ° F. | 720 |
| T70 | M1567 | ° F. | 794 |
| T80 | M1567 | ° F. | 897 |
| T90 | M1567 | ° F. | 994 |
| T95 | M1567 | ° F. | 1167 |
| T99.5 | M1567 | ° F. | 1348 |

Example 2—Second Hydroprocessed Products

Example 2a: Second Hydroprocessed Product IV

Composition and property details for a Second Hydroprocessed Product IV were determined and are shown in Table 4 below.

TABLE 4

| Second Hydroprocessed Product IV | | | |
|---|---|---|---|
| Characteristic | Method | Unit | Result |
| Properties | | | |
| Kinematic Viscosity @ 50° C. | Calculated | $mm^2/s$ | 219.0 |
| Density at 15° C. | D4052 | g/ml | 1.0532 |
| Solubility number | AMS 99-011 | — | 165 |
| Insolubility number | AMS 99-011 | — | 103 |
| BMCI | Calculated | — | 115.9 |
| Asphaltenes | D6560 (estimated from carbon residue) | wt % | 5.7 |
| CCAI | Calculated | — | 908 |
| Micro Carbon Residue | D4530 | mass % | 8.57 |
| Flash Point | D6450 | ° C. | 143 |
| Pour Point | D5949 | ° C. | −3 |

TABLE 4-continued

| Second Hydroprocessed Product IV | | | |
|---|---|---|---|
| Characteristic | Method | Unit | Result |
| Energy content (net) | Calculated (estimated by ISO8217, Annex E. 0.10 vol % water and 0.01% wt ash) | MJ/kg | 42.3 |
| | Calculated | BTU/gal | 151934 |
| | Composition | | |
| Sulfur | D2622 | mass % | 0.07699 |
| Hydrogen | D7171 | mass % | 8.519 |
| Nitrogen | B1208 | mass % | 0.06948 |
| Paraffins | 2D GC* | wt % | 0.06 |
| Naphthene - single ring | 2D GC* | wt % | 0.09 |
| Naphthene - double ring | 2D GC* | wt % | 0.62 |
| Total naphthenes | Calculated | wt % | 0.71 |
| Aromatics - 1 ring class | 2D GC* | wt % | 2.15 |
| Aromatics - 1.5 ring class | 2D GC* | wt % | 8.82 |
| Aromatics - 2 ring class | 2D GC* | wt % | 13.27 |
| Aromatics - 2.5 ring class | 2D GC* | wt % | 18.40 |
| Aromatics - 3 ring class | 2D GC* | wt % | 16.59 |
| Aromatics - 3.5 ring class | 2D GC* | wt % | 15.37 |
| Aromatics - 4 ring class | 2D GC* | wt % | 10.87 |
| Aromatics - 4.5 ring class | 2D GC* | wt % | 5.97 |
| Aromatics - 5 ring class | 2D GC* | wt % | 4.71 |
| Aromatics - 5.5 ring class | 2D GC* | wt % | 3.07 |
| Total aromatics | Calculated | wt % | 99.23 |
| | Distillation | | |
| T0.5 | D6352 | ° F. | 351.1 |
| T5 | D6352 | ° F. | 488.1 |
| T10 | D6352 | ° F. | 546.0 |
| T20 | D6352 | ° F. | 605.6 |
| T30 | D6352 | ° F. | 647.7 |
| T40 | D6352 | ° F. | 687.8 |
| T50 | D6352 | ° F. | 734.5 |
| T60 | D6352 | ° F. | 787.1 |
| T70 | D6352 | ° F. | 853.9 |
| T80 | D6352 | ° F. | 944.4 |
| T90 | D6352 | ° F. | 1078.2 |
| T95 | D6352 | ° F. | 1175.9 |
| T99.5 | D6352 | ° F. | 1345.8 |

*2D GC was measured for portion of Second Hydroprocessed Product IV with a boiling point up to 1050° F.

Figure 2:
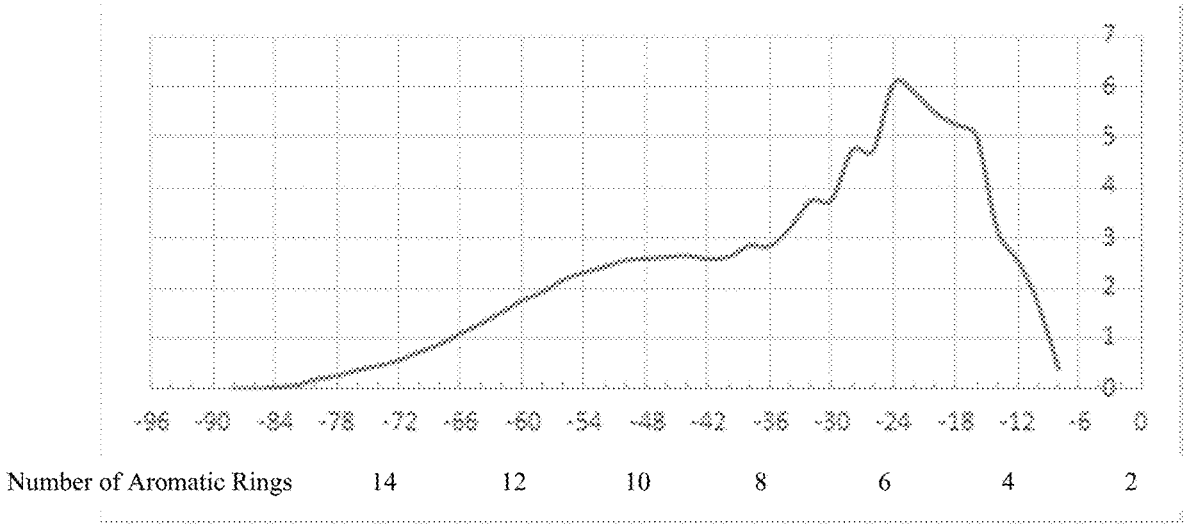
FIG. 2 illustrates distribution of aromatic rings in the Second Hydroprocessed Product IV with a boiling range greater than 600° F. where the x-axis represents the number of aromatic rings and the y-axis represents % mass.

FIG. 2 shows the distribution of aromatic rings in the Second Hydroprocessed Product IV with a boiling range greater than 600° F. where the x-axis represent the number of aromatic rings and the y-axis represents % mass. The distribution of aromatic rings in the Second Hydroprocessed Product IV was determined as described above for FIG. 1.

Example 2b: Second Hydroprocessed Product V

Composition and property details for a Second Hydroprocessed Product V were determined and are shown in Table 5 below.

TABLE 5

| Second Hydroprocessed Product V | | | |
|---|---|---|---|
| Characteristic | Method | Unit | Result |
| | Properties | | |
| Kinematic Viscosity @ 100° C. | D7042 | $mm^2/s$ | 24.829 |
| Kinematic Viscosity @ 60° C. | D7042 | $mm^2/s$ | 284.56 |
| Kinematic Viscosity @ 50° C. | Calculated (based on viscosity at 60 and 100° C.) | $mm^2/s$ | 709.8 |
| Density at 15° C. | D4052 | g/ml | 1.0615 |
| Solubility number | AMS 99-011 | — | 196 |
| Insolubility number | AMS 99-011 | — | 93 |
| BMCI | Calculated | — | 118.4 |
| Total sediment aged | IS010307-2 | mass % | <0.01 |
| Asphaltenes | D6560 (estimated from carbon residue) | wt % | 5.4 |
| CCAI | Calculated | — | 917 |
| Micro Carbon Residue | D4530 | mass % | 8.08 |
| Flash Point | D6450 | ° C. | 153 |
| Pour Point | D5949 | ° C. | 6 |
| Energy content (net) | Calculated (estimated by ISO8217, Annex E. 0.10 vol % water and 0.01% wt ash) | MJ/kg | 40.1 |
| | Calculated | BTU/gal | 152593 |
| | Composition | | |
| Sulfur | D2622 | mass % | 0.122 |
| Carbon | D5291 | mass % | 90.6 |
| Hydrogen | D5291 | mass % | 8.66 |
| Nitrogen | D5291 | mass % | <0.10 |
| Paraffins | 2D GC* | wt % | 0.11 |
| Naphthene - single ring | 2D GC* | wt % | 0.13 |
| Naphthene - double ring | 2D GC* | wt % | 0.37 |
| Total naphthenes | Calculated | wt % | 0.50 |
| Aromatics - 1 ring class | 2D GC* | wt % | 1.54 |
| Aromatics - 1.5 ring class | 2D GC* | wt % | 6.75 |
| Aromatics - 2 ring class | 2D GC* | wt % | 12.99 |
| Aromatics - 2.5 ring class | 2D GC* | wt % | 19.82 |
| Aromatics - 3 ring class | 2D GC* | wt % | 16.96 |
| Aromatics - 3.5 ring class | 2D GC* | wt % | 15.34 |
| Aromatics - 4 ring class | 2D GC* | wt % | 10.99 |
| Aromatics - 4.5 ring class | 2D GC* | wt % | 6.32 |
| Aromatics - 5 ring class | 2D GC* | wt % | 5.07 |
| Aromatics - 5.5 ring class | 2D GC* | wt % | 3.61 |
| Total aromatics | Calculated | wt % | 99.40 |
| | Distillation | | |
| T0.5 | D6352 | ° F. | 418 |
| T5 | D6352 | ° F. | 535 |
| T10 | D6352 | ° F. | 576 |
| T20 | D6352 | ° F. | 624 |
| T30 | D6352 | ° F. | 665 |
| T40 | D6352 | ° F. | 708 |
| T50 | D6352 | ° F. | 758 |
| T60 | D6352 | ° F. | 815 |
| T70 | D6352 | ° F. | 889 |
| T80 | D6352 | ° F. | 984 |
| T90 | D6352 | ° F. | 1116 |

TABLE 5-continued

| Second Hydroprocessed Product V | | | |
|---|---|---|---|
| Characteristic | Method | Unit | Result |
| T95 | D6352 | ° F. | 1150 |
| T99.5 | D6352 | ° F. | 1350 |

*2D GC was measured for portion of Second Hydroprocessed Product V with a boiling point up to 1050° F.

Figure 3:
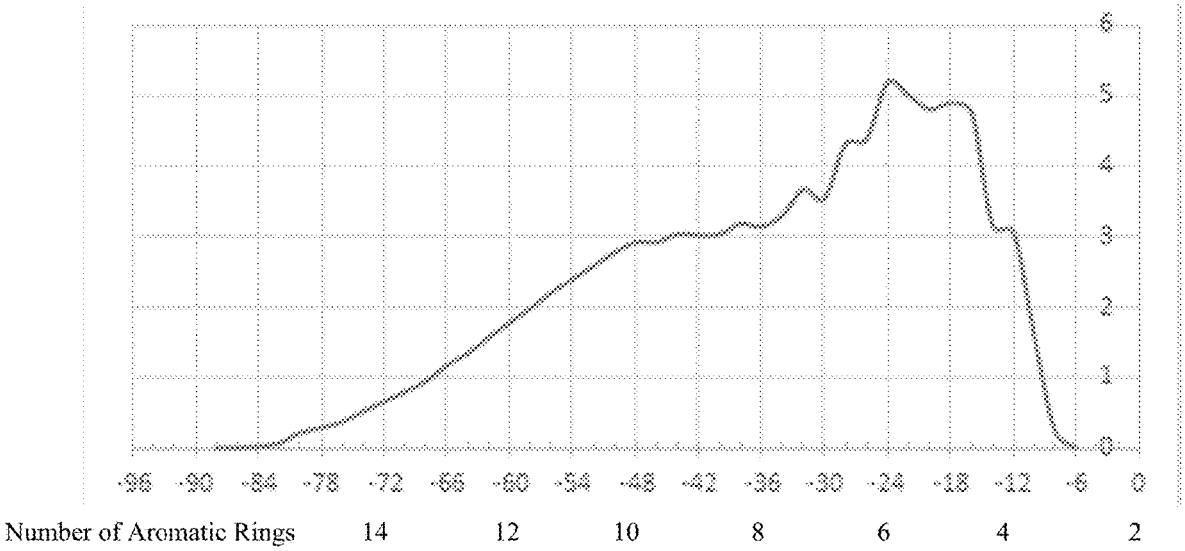
FIG. 3 illustrates distribution of aromatic rings in the Second Hydroprocessed Product V with a boiling range greater than 600° F. where the x-axis represents the number of aromatic rings and the y-axis represents % mass.

FIG. 3 shows the distribution of aromatic rings in the Second Hydroprocessed Product V with a boiling range greater than 600° F. where the x-axis represent the number of aromatic rings and the y-axis represents % mass. The distribution of aromatic rings in the Second Hydroprocessed Product V was determined as described above for FIG. 1.

Example 2c: Second Hydroprocessed Product VI

Composition and property details for a Second Hydroprocessed Product VI were determined and are shown in Table 6 below.

TABLE 6

| Second Hydroprocessed Product VI | | | |
|---|---|---|---|
| Characteristic | Method | Unit | Result |
| Properties | | | |
| Density at 25° C. | D4052 | g/ml | 1.061 |
| Solubility number | AMS 99-011 | — | 171 |
| Insolubility number | AMS 99-011 | — | 89 |
| BMCI | Calculated (assumed density at 15° C. = 1.068 g/ml) | — | 120.0 |
| Total Acid Number | D664 | mgKOH/g | 0.13 |
| n-Heptane insolubles | D3279 | wt % | 2.1 |
| CCAI | Calculated | — | |
| Micro Carbon Residue | D4530 | mass % | 11.2 |
| Flash Point | D6450 | ° C. | |
| Pour Point | D5949 | ° C. | |
| Energy content (net) | Calculated (estimated by ISO8217, Annex E. 0.10 vol % water and 0.01% wt ash) | MJ/kg | 39.9 |
| | Calculated | BTU/gal | 152979 |
| Composition | | | |
| Sulfur | D2622 | mass % | 0.260 |
| Carbon | D5291 | mass % | 90.6 |
| Hydrogen | D5291 | mass % | 8.40 |
| Nitrogen | D5291 | mass % | <0.10 |
| Distillation | | | |
| T0.5 | D6352 | ° F. | 448 |
| T5 | D6352 | ° F. | 561 |
| T10 | D6352 | ° F. | 597 |
| T20 | D6352 | ° F. | 644 |
| T30 | D6352 | ° F. | 687 |
| T40 | D6352 | ° F. | 733 |
| T50 | D6352 | ° F. | 784 |
| T60 | D6352 | ° F. | 846 |
| T70 | D6352 | ° F. | 923 |
| T80 | D6352 | ° F. | 1021 |
| T90 | D6352 | ° F. | 1152 |
| T95 | D6352 | ° F. | 1244 |
| T99.5 | D6352 | ° F. | 1355 |

Example 3—Fuel Blends

Example 3a: Fuel Blend A

A Fuel Blend A was prepared by blending 60 wt % Second Hydroprocessed Product V with 40 wt % hydrotreated gas oil. Composition and property details for the hydrotreated gas oil were determined and are shown in Table 7 below.

TABLE 7

| Hydrotreated Gas Oil | | | |
|---|---|---|---|
| Characteristic | Method | Unit | Result |
| Properties | | | |
| Kinematic Viscosity @ 50° C. | D445 | $mm^2/s$ | 9.853 |
| Density at 15° C. | D4052 | g/ml | 0.875 |
| Solubility number | AMS 99-011 | — | 30 |
| Insolubility number | AMS 99-011 | — | 0 |
| BMCI | Calculated | — | 32.9 |
| Asphaltenes | D6560 (estimated from carbon residue) | wt % | 0.0 |
| CCAI | Calculated | — | 793 |
| Micro Carbon Residue | D4530 | mass % | 0.01 |
| Flash Point | D6450 | ° C. | 164.1 |
| Pour Point | D5949 | ° C. | 24 |
| Energy content (net) | Calculated (estimated by ISO8217, Annex E. 0.01 vol % water and 0.0005% wt ash) | MJ/kg | 42.4 |
| | Calculated | BTU/gal | 133191 |
| Composition | | | |
| Sulfur | D2622 | mass % | 0.128 |
| Carbon | D5291 | mass % | 76.3 |
| Hydrogen | D5291 | mass % | 11.2 |
| Nitrogen | D5291 | mass % | <0.10 |
| N-Paraffins | 2D GC | mass % | 17.02 |
| Iso-Paraffins | 2D GC | mass % | 17.69 |
| Naphthenes | 2D GC | mass % | 22.10 |
| Aromatics | 2D GC | mass % | 43.19 |
| Distillation | | | |
| T0.5 | D6352 | ° F. | 461 |
| T5 | D6352 | ° F. | 561 |
| T10 | D6352 | ° F. | 600 |
| T20 | D6352 | ° F. | 648 |
| T30 | D6352 | ° F. | 676 |
| T40 | D6352 | ° F. | 698 |
| T50 | D6352 | ° F. | 718 |
| T60 | D6352 | ° F. | 736 |
| T70 | D6352 | ° F. | 755 |
| T80 | D6352 | ° F. | 775 |
| T90 | D6352 | ° F. | 804 |
| T95 | D6352 | ° F. | 830 |
| T99.5 | D6352 | ° F. | 903 |

The distribution of n-paraffins and iso-paraffins from Table 7 as a function of carbon number is provided below in Table 8.

TABLE 8

| C No. | N-Paraffins | Iso-Paraffins |
|---|---|---|
| 8 | 0.00% | 0.00% |
| 9 | 0.00% | 0.00% |
| 10 | 0.00% | 0.00% |
| 11 | 0.00% | 0.00% |
| 12 | 0.01% | 0.01% |
| 13 | 0.01% | 0.02% |
| 14 | 0.00% | 0.03% |

TABLE 8-continued

| C No. | N-Paraffins | Iso-Paraffins |
|---|---|---|
| 15 | 0.02% | 0.05% |
| 16 | 0.04% | 0.09% |
| 17 | 0.08% | 0.16% |
| 18 | 0.16% | 0.24% |
| 19 | 0.35% | 0.46% |
| 20 | 0.52% | 0.72% |
| 21 | 0.82% | 1.16% |
| 22 | 1.28% | 1.61% |
| 23 | 1.89% | 2.19% |
| 24 | 2.35% | 2.27% |
| 25 | 2.45% | 2.26% |
| 26 | 2.15% | 1.89% |
| 27 | 1.68% | 1.57% |
| 28 | 1.19% | 1.08% |
| 29 | 0.80% | 0.72% |
| 30 | 0.51% | 0.45% |
| 31 | 0.30% | 0.30% |
| 32 | 0.18% | 0.19% |
| 33 | 0.11% | 0.11% |
| 34 | 0.06% | 0.06% |
| 35 | 0.03% | 0.03% |
| 36 | 0.02% | 0.01% |
| 37 | 0.01% | 0.00% |
| 38 | 0.00% | 0.00% |
| 39 | 0.00% | 0.00% |
| 40 | 0.00% | 0.00% |
| 41 | 0.00% | 0.00% |
| 42 | 0.00% | 0.00% |
| 43 | 0.00% | 0.00% |
| 44 | 0.00% | 0.00% |
| 45 | 0.00% | 0.00% |
| Total | 17.02% | 17.69% |

Composition and property details for Fuel Blend A were determined and are shown in Table 9 below.

TABLE 9

| Fuel Blend A | | | |
|---|---|---|---|
| Characteristic | Method | Unit | Result |
| Properties | | | |
| Kinematic Viscosity @ 50° C. | D445 | $mm^2/s$ | 56.6 |
| Density at 15° C. | D4052 | g/ml | 0.9860 |
| Solubility number | AMS 99-011 | — | 115 |
| Insolubility number | AMS 99-011 | — | 85 |
| BMCI | Calculated | — | 84.1 |
| Total sediment aged | ISO10307-2 | mass % | 0.01 |
| Asphaltenes | D6560 (estimated from carbon residue) | wt % | 3.6 |
| CCAI | Calculated | — | 870 |
| Estimated cetane number | IP541 | — | 15.1 |
| Micro Carbon Residue | D4530 | mass % | 5.34 |
| Flash Point | D6450 | ° C. | 160.1 |
| Pour Point | D5950 | ° C. | −18 |
| Energy content (net) | Calculated (estimated by ISO8217, Annex E. 0.10 vol % water and 0.01% wt ash) | MJ/kg | 41.2 |
| | Calculated | BTU/gal | 145682 |
| Composition | | | |
| Sulfur | D2622 | mass % | 0.127 |
| Carbon | D5291 | mass % | 89.1 |
| Hydrogen | D5291 | mass % | 10.1 |
| Nitrogen | D5291 | mass % | <0.10 |

TABLE 9-continued

| Fuel Blend A | | | |
|---|---|---|---|
| Characteristic | Method | Unit | Result |
| Distillation | | | |
| T0.5 | D6352 | ° F. | 429 |
| T5 | D6352 | ° F. | 545 |
| T10 | D6352 | ° F. | 584 |
| T20 | D6352 | ° F. | 633 |
| T30 | D6352 | ° F. | 670 |
| T40 | D6352 | ° F. | 702 |
| T50 | D6352 | ° F. | 733 |
| T60 | D6352 | ° F. | 765 |
| T70 | D6352 | ° F. | 807 |
| T80 | D6352 | ° F. | 882 |
| T90 | D6352 | ° F. | 1031 |
| T95 | D6352 | ° F. | 1143 |
| T99.5 | D6352 | ° F. | 1331 |

Example 3b: Fuel Blend B

A Fuel Blend B was prepared by blending 50 wt % Second Hydroprocessed Product V with 50 wt % marine gas oil. Composition and property details for the marine gas oil were determined and are shown in Table 10 below.

TABLE 10

| Marine Gas Oil | | | |
|---|---|---|---|
| Characteristic | Method | Unit | Result |
| Properties | | | |
| Kinematic Viscosity @ 50° C. | D445 | $mm^2/s$ | 4.2765 |
| Density at 15° C. | D4052 | g/ml | 0.8548 |
| Solubility number | AMS 99-011 | — | 30 |
| Insolubility number | AMS 99-011 | — | 0 |
| BMCI | Calculated | — | 29.9 |
| Asphaltenes | D6560 (estimated from carbon residue) | wt % | 0.0 |
| CCAI | Calculated | — | 795 |
| Micro Carbon Residue | D4530 | mass % | <0.001 |
| Flash Point | D6450 | ° C. | 91.8 |
| Pour Point | D5950 | ° C. | 9 |
| Energy content (net) | Calculated (estimated by ISO8217, Annex E. 0.01 vol % water and 0.0005% wt ash) | MJ/kg | 42.7 |
| | Calculated | BTU/gal | 130913 |
| Composition | | | |
| Sulfur | D2622 | mass % | 0.0526 |
| Carbon | D5291 | mass % | 77.2 |
| Hydrogen | D5291 | mass % | 11.8 |
| Nitrogen | D5291 | mass % | <0.10 |
| N-Paraffins | 2D-GC | mass % | 17.02 |
| Iso-Paraffins | 2D-GC | mass % | 17.69 |
| Naphthenes | 2D-GC | mass % | 26.86 |
| Aromatics | 2D-GC | mass % | 36.84 |
| Distillation | | | |
| T0.5 | D6352 | ° F. | 274 |
| T5 | D6352 | ° F. | 391 |
| T10 | D6352 | ° F. | 444 |
| T20 | D6352 | ° F. | 509 |
| T30 | D6352 | ° F. | 552 |
| T40 | D6352 | ° F. | 587 |
| T50 | D6352 | ° F. | 617 |
| T60 | D6352 | ° F. | 649 |
| T70 | D6352 | ° F. | 676 |

TABLE 10-continued

| Marine Gas Oil | | | |
|---|---|---|---|
| Characteristic | Method | Unit | Result |
| T80 | D6352 | ° F. | 709 |
| T90 | D6352 | ° F. | 753 |
| T95 | D6352 | ° F. | 786 |
| T99.5 | D6352 | ° F. | 867 |

The distribution of n-paraffins and iso-paraffins from Table 11 as a function of carbon number is provided below in Table 11.

TABLE 11

| C No. | N-Paraffins | Iso-Paraffins |
|---|---|---|
| 8 | 0.01% | 0.01% |
| 9 | 0.09% | 0.14% |
| 10 | 0.16% | 0.26% |
| 11 | 0.26% | 0.34% |
| 12 | 0.34% | 0.46% |
| 13 | 0.43% | 0.60% |
| 14 | 0.53% | 0.74% |
| 15 | 0.69% | 0.98% |
| 16 | 0.88% | 1.09% |
| 17 | 1.24% | 1.48% |
| 18 | 1.61% | 1.51% |
| 19 | 1.49% | 1.61% |
| 20 | 1.54% | 1.82% |
| 21 | 1.51% | 1.72% |
| 22 | 1.40% | 1.62% |
| 23 | 1.19% | 1.36% |
| 24 | 0.94% | 1.12% |
| 25 | 0.70% | 0.82% |
| 26 | 0.54% | 0.65% |
| 27 | 0.38% | 0.48% |
| 28 | 0.24% | 0.38% |
| 29 | 0.15% | 0.25% |
| 30 | 0.09% | 0.16% |
| 31 | 0.05% | 0.09% |
| 32 | 0.02% | 0.05% |
| 33 | 0.01% | 0.03% |
| 34 | 0.01% | 0.01% |
| 35 | 0.00% | 0.01% |
| 36 | 0.00% | 0.00% |
| 37 | 0.00% | 0.00% |
| 38 | 0.00% | 0.00% |
| 39 | 0.00% | 0.00% |
| 40 | 0.00% | 0.00% |
| 41 | 0.00% | 0.00% |
| 42 | 0.00% | 0.00% |
| 43 | 0.00% | 0.00% |
| 44 | 0.00% | 0.00% |
| 45 | 0.00% | 0.00% |
| Total | 17.02% | 17.69% |

Composition and property details for Fuel Blend B were determined and are shown in Table 12 below.

TABLE 12

| Fuel Blend B | | | |
|---|---|---|---|
| Characteristic | Method | Unit | Result |
| Properties | | | |
| Kinematic Viscosity @ 50° C. | Calculated (calculated from KV40 and KV100 by ASTM D341) | $mm^2/s$ | 19.2 |
| Kinematic Viscosity @ 100° C. | D7042 | $mm^2/s$ | 4.4454 |
| Kinematic Viscosity @ 40° C. | D7042 | $mm^2/s$ | 29.703 |

TABLE 12-continued

| Fuel Blend B | | | |
|---|---|---|---|
| Characteristic | Method | Unit | Result |
| Density at 15° C. | D4052 (calculated from density at 60° F., assuming coefficient of expansion of 0.0007) | g/ml | 0.9600 |
| BMCI | Calculated | — | 75.4 |
| Total sediment aged | ISO10307-2 | mass % | 0.05 |
| Asphaltenes | D6560 (estimated from carbon residue) | wt % | 3.1 |
| CCAI | Calculated | — | 858 |
| Estimated cetane number | IP541 | — | 25.4 |
| Micro Carbon Residue | D4530 | mass % | 4.58 |
| Flash Point | D6450 | ° C. | 108.7 |
| Pour Point | D5950 | ° C. | −36 |
| Energy content (net) | Calculated (estimated by ISO8217, Annex E. 0.10 vol % water and 0.01% wt ash) | MJ/kg | 41.6 |
| | Calculated | BTU/gal | 143120 |
| Composition | | | |
| Sulfur | D2622 | mass % | 0.0932 |
| Carbon | D5291 | mass % | 89.1 |
| Hydrogen | D5291 | mass % | 10.6 |
| Nitrogen | D5291 | mass % | 0.11 |
| Distillation | | | |
| T0.5 | D6352 | ° F. | 150 |
| T5 | D6352 | ° F. | 433 |
| T10 | D6352 | ° F. | 498 |
| T20 | D6352 | ° F. | 565 |
| T30 | D6352 | ° F. | 606 |
| T40 | D6352 | ° F. | 643 |
| T50 | D6352 | ° F. | 677 |
| T60 | D6352 | ° F. | 717 |
| T70 | D6352 | ° F. | 768 |
| T80 | D6352 | ° F. | 848 |
| T90 | D6352 | ° F. | 1006 |
| T95 | D6352 | ° F. | 1134 |
| T99.5 | D6352 | ° F. | 1334 |

Example 3c: Fuel Blend C

A Fuel Blend C was prepared by blending 60 wt % First Hydroprocessed Product III? with 40 wt % hydrotreated gas oil as described in Example 3a. Composition and property details for Fuel blend C were determined and are shown in Table 13 below.

TABLE 13

| Fuel Blend C | | | |
|---|---|---|---|
| Characteristic | Method | Unit | Result |
| Properties | | | |
| Kinematic Viscosity @ 50° C. | D7042 | $mm^2/s$ | 17.730 |
| Density at 15° C. | D4052 (calculated from density at 60° F., assuming coefficient of expansion of 0.0007) | g/ml | 0.9736 |

TABLE 13-continued

| Fuel Blend C | | | |
|---|---|---|---|
| Characteristic | Method | Unit | Result |
| BMCI | Calculated | — | 80.0 |
| Asphaltenes | D6560 (estimated from carbon residue) | wt % | 3.0 |
| CCAI | Calculated | — | 877 |
| Estimated cetane number | IP541 | — | 18.5 |
| Micro Carbon Residue | D4530 | mass % | 4.44 |
| Flash Point | D6450 | ° C. | 115.4 |
| Pour Point | D5950 | ° C. | −33 |
| Energy content (net) | Calculated (estimated by ISO8217, Annex E. 0.10 vol % water and 0.01% wt ash) | MJ/kg | 41.3 |
| | Calculated | BTU/gal | 144171 |
| Composition | | | |
| Sulfur | D2622 | mass % | 0.303 |
| Carbon | D5291 | mass % | 89.4 |
| Hydrogen | D5291 | mass % | 10.3 |
| Nitrogen | D5291 | mass % | 0.12 |
| Distillation | | | |
| T0.5 | M1567 | ° F. | 329 |
| T5 | M1567 | ° F. | 430 |
| T10 | M1567 | ° F. | 480 |
| T20 | M1567 | ° F. | 558 |
| T30 | M1567 | ° F. | 613 |
| T40 | M1567 | ° F. | 660 |
| T50 | M1567 | ° F. | 699 |
| T60 | M1567 | ° F. | 734 |
| T70 | M1567 | ° F. | 772 |
| T80 | M1567 | ° F. | 827 |
| T90 | M1567 | ° F. | 972 |
| T95 | M1567 | ° F. | 1108 |
| T99.5 | M1567 | ° F. | 1330 |

Example 4—Overhead Stream (Light Cut Stream) and Mid-Cut Stream

Composition and property details for an overhead stream (or light cut stream) and mid-cut stream from a first hydroprocessed product were determined and are shown in Table 14 below.

TABLE 14

| Overhead Stream (Light Cut Stream) and Mid-Cut Stream | | | | |
|---|---|---|---|---|
| Property | Method | units | Overhead (Light Cut) | Mid-Cut |
| Aromatics-Polycyclic | EN12916 | wt % | 13.7 | 37.3 |
| Color | ASTM D1500 | — | 0.5 | 1.0 |
| Cetane Index | ASTM D4737 | — | 16.7 | 18.9 |
| Density @ 15° C. | ASTM D4052 | kg/m$^3$ | 941 | 983 |
| Dist IBP | ASTM D2887 | ° F. | 294 | 528.3 |
| Dist 5% | ASTM D2887 | ° F. | 369 | 534.9 |
| Dist 10% | ASTM D2887 | ° F. | 393 | 535.6 |
| Dist 20% | ASTM D2887 | ° F. | 418 | 543.2 |
| Dist 30% | ASTM D2887 | ° F. | 444 | 546.6 |
| Dist 40% | ASTM D2887 | ° F. | 464 | 553.6 |
| Dist 50% | ASTM D2887 | ° F. | 481 | 560.7 |
| Dist 60% | ASTM D2887 | ° F. | 495 | 571.1 |
| Dist 70% | ASTM D2887 | ° F. | 510 | 577.9 |
| Dist 80% | ASTM D2887 | ° F. | 527 | 598.1 |
| Dist 90% | ASTM D2887 | ° F. | 547 | 630.7 |
| Dist 95% | ASTM D2897 | ° F. | 570 | 650.8 |
| Dist EBP | ASTM D2887 | ° F. | 634 | 658.2 |
| Flash point | ASTM D93 | ° C. | 80.5 | 124 |
| Pour point | ASTM D97 | ° C. | <−57 | −51 |
| Sulfur | ASTM D5453 | ppm m/m | 12 | 1100 |
| Viscosity @ 40° C. | ASTM D445 | cSt | 2.344 | 5.68 |

The invention claimed is:

1. A first hydroprocessed product comprising:

aromatics in an amount ≥about 50 wt %;

paraffins in an amount ≤about 5.0 wt %; ≤5 wt. % of the combination of 1.0 ring naphthenes and 2.0 ring naphthenes; and sulfur in an amount from about 0.10 wt % to <0.50 wt %;

wherein the first hydroprocessed product has:

a boiling point distribution of about 145° C. to about 760° C. as measured according to ASTM D6352;

a pour point of ≤about 0.0° C., as measured according to ASTM D7346; and a kinematic viscosity at 50° C. from 20 mm$^2$/s to 200 mm$^2$/s, as measured according to ASTM D7042.

2. The first hydroprocessed product of claim 1 further comprising asphaltenes in an amount from about 2.0 wt % to 10 wt %.

3. The first hydroprocessed product of claim 1, wherein the aromatics are present in an amount of ≥about 80 wt %.

4. The first hydroprocessed product of claim 1, wherein the first hydroprocessed product comprises one or more of:

(a) ≥1.0 wt % of 1.0 ring class compounds;

(b) ≥10 wt % of 1.5 ring class compounds;

(c) ≥10 wt % of 2.0 ring class compounds;

(d) ≥10 wt % of 2.5 ring class compounds; and (e) ≥5.0 wt % of 3.0 ring class compounds;

based on the weight of the first hydroprocessed product.

5. The first hydroprocessed product of claim 1 having a pour point of ≤−5.0° C., as measured according to ASTM D7346.

6. The first hydroprocessed product of claim 1 having one or more of the following:

(i) a Bureau of Mines Correlation Index (BMCI) of ≥about 100;

(ii) a solubility number ($S_n$) of ≥about 130; and (iii) an energy content of ≥about 35 MJ/kg.

7. A second hydroprocessed product comprising:
aromatics in an amount ≥about 50 wt %;
paraffins in an amount ≤about 5.0 wt %; ≤5 wt. % of the combination of 1.0 ring naphthenes and 2.0 ring naphthenes; and
sulfur in an amount ≤0.30 wt %;
wherein the second hydroprocessed product has:
a boiling point distribution of about 140° C. to about 760° C. as measured according to ASTM D6352;
a pour point of ≤about 12° C., as measured according to ASTM D5949; and
a kinematic viscosity at 50° C. from 100 $mm^2/s$ to 800 $mm^2/s$, as measured according to ASTM D7042.

8. The second hydroprocessed product of claim 7 further comprising asphaltenes in an amount from about 2.0 wt % to 10 wt %.

9. The second hydroprocessed product of claim 7, wherein the aromatics are present in an amount of ≥about 80 wt %.

10. The second hydroprocessed product of claim 7, wherein the second hydroprocessed product comprises one or more of:
(a) ≥1.0 wt % of 1.0 ring class compounds;
(b) ≥5.0 wt % of 1.5 ring class compounds;
(c) ≥5.0 wt % of 2.0 ring class compounds;
(d) ≥10 wt % of 2.5 ring class compounds;
(d) ≥10 wt % of 3.0 ring class compounds; and
(e) ≥10 wt % of 3.5 ring class compounds
based on the weight of the second hydroprocessed product.

11. The second hydroprocessed product of claim 7 having one or more of the following:
(i) a Bureau of Mines Correlation Index (BMCI) of ≥about 100;
(ii) a solubility number ($S_n$) of ≥about 150; and
(iii) an energy content of ≥about 35 MJ/kg.

12. A fuel blend comprising:
the first hydroprocessed product of claim 1 and/or the second hydroprocessed product of claim 7; and
a fuel stream.

13. The fuel blend of claim 12, wherein the fuel stream comprises a low sulfur diesel, an ultra low sulfur diesel, a low sulfur gas oil, an ultra low sulfur gas oil, a low sulfur kerosene, an ultra low sulfur kerosene, a hydrotreated straight run diesel, a hydrotreated straight run gas oil, a hydrotreated straight run kerosene, a hydrotreated cycle oil, a hydrotreated thermally cracked diesel, a hydrotreated thermally cracked gas oil, a hydrotreated thermally cracked kerosene, a hydrotreated coker diesel, a hydrotreated coker gas oil, a hydrotreated coker kerosene, a hydrocracker diesel, a hydrocracker gas oil, a hydrocracker kerosene, a gas-to-liquid diesel, a gas-to-liquid kerosene, a hydrotreated vegetable oil, a fatty acid methyl esters, a non-hydrotreated straight-run diesel, a non-hydrotreated straight-run kerosene, a non-hydrotreated straight-run gas oil, a distillate derived from low sulfur crude slates, a gas-to-liquid wax, gas-to-liquid hydrocarbons, a non-hydrotreated cycle oil, a non-hydrotreated fluid catalytic cracking slurry oil, a non-hydrotreated pyrolysis gas oil, a non-hydrotreated cracked light gas oil, a non-hydrotreated cracked heavy gas oil, a non-hydrotreated pyrolysis light gas oil, a non-hydrotreated pyrolysis heavy gas oil, a non-hydrotreated thermally cracked residue, a non-hydrotreated thermally cracked heavy distillate, a non-hydrotreated coker heavy distillates, a non-hydrotreated vacuum gas oil, a non-hydrotreated coker diesel, a non-hydrotreated coker gasoil, a non-hydrotreated coker vacuum gas oil, a non-hydrotreated thermally cracked vacuum gas oil, a non-hydrotreated thermally cracked diesel, a non-hydrotreated thermally cracked gas oil, a Group 1 slack wax, a lube oil aromatic extracts, a deasphalted oil, an atmospheric tower bottoms, a vacuum tower bottoms, a steam cracker tar, a residue material derived from low sulfur crude slates, an ultra low sulfur fuel oil (ULSFO), a low sulfur fuel oil (LSFO), regular sulfur fuel oil (RSFO), a marine fuel oil, a hydrotreated residue material, a hydrotreated fluid catalytic cracking slurry oil, and a combination thereof.

14. The fuel blend of claim 12, wherein the first hydroprocessed product and/or the second hydroprocessed product is present in an amount of about 40 wt % to about 70 wt %, and the fuel stream is present in an amount of about 30 wt % to about 60 wt %.

15. The fuel blend of claim 12, wherein the fuel blend comprises the second hydroprocessed product of claim 7 and comprises sulfur in an amount <about 0.50 wt % and has:
a pour point of ≤about −5.0° C., as measured according to ASTM D5950;
a kinematic viscosity at 50° C. from 10 $mm^2/s$ to 180 $mm^2/s$, as measured according to ASTM D7042; and
an energy content of ≥about 35 MJ/kg.

16. A method of lowering pour point of a gas oil comprising blending the first hydroprocessed product of claim 1 and/or the second hydroprocessed product of claim 7 with a gas oil to form a blended gas oil, which has a pour point lower than the pour point of the gas oil.

17. The method of claim 16, wherein the pour point of the gas oil prior to blending is ≥0.0° C. and after blending the pour point of the blended gas oil is ≤about −5.0° C.

18. The method of claim 16, wherein the blended gas oil has a pour point at least 5° C. lower than the pour point of the gas oil prior to blending.

19. The method of claim 16, wherein the blended gas oil comprises sulfur in an amount ≤about 0.50 wt % and has:
a kinematic viscosity at 50° C. from 10 $mm^2/s$ to 180 $mm^2/s$, as measured according to ASTM D7042; and
an energy content of ≥about 35 MJ/kg.

20. The method of claim 16, wherein the blended gas oil comprises sulfur in an amount ≤about 0.30 wt %.

21. The method of claim 16 wherein the gas oil is off-spec marine gas oil, on-spec marine gas oil or hydrotreated gas oil.

* * * * *